US009984695B2

(12) United States Patent
Thesing et al.

(10) Patent No.: US 9,984,695 B2
(45) Date of Patent: May 29, 2018

(54) METHODS AND SYSTEMS FOR EFFICIENT RECOVERY OF HIGH FREQUENCY AUDIO CONTENT

(71) Applicant: DOLBY INTERNATIONAL AB, Amsterdam Zuidoost (NL)

(72) Inventors: Robin Thesing, Nuremberg (DE); Michael Schug, Erlangen (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days. days.

(21) Appl. No.: 15/494,195

(22) Filed: Apr. 21, 2017

(65) Prior Publication Data

US 2017/0221491 A1 Aug. 3, 2017

Related U.S. Application Data

(62) Division of application No. 14/372,733, filed as application No. PCT/EP2013/053609 on Feb. 22, 2013, now Pat. No. 9,666,200.
(Continued)

(30) Foreign Application Priority Data

Feb. 23, 2012 (EP) ..... 12156631

(51) Int. Cl.
*G10L 19/008* (2013.01)
*G10L 19/16* (2013.01)
*G10L 19/028* (2013.01)

(52) U.S. Cl.
CPC ..... *G10L 19/008* (2013.01); *G10L 19/028* (2013.01); *G10L 19/167* (2013.01)

(58) Field of Classification Search
CPC .... G10L 19/008; G10L 19/028; G10L 19/167
(Continued)

(56) References Cited

U.S. PATENT DOCUMENTS 6,978,001 B1 12/2005 Shaffer
7,012,630 B2 3/2006 Curry
(Continued)

FOREIGN PATENT DOCUMENTS

CN 1647155 7/2005
CN 1734555 2/2006
(Continued)

OTHER PUBLICATIONS

Dimkoviae, I. et al. "Fast Software Implementation of MPEG Advanced Audio Encoder" 14th International Conference on Digital Signal Processing, vol. 2, 2002, pp. 839-843.
(Continued)

*Primary Examiner* — David Ton

(57) ABSTRACT

The present document relates to the technical field of audio coding, decoding and processing. It specifically relates to methods of recovering high frequency content of an audio signal from low frequency content of the same audio signal in an efficient manner. A method for determining a first banded tonality value for a first frequency subband of an audio signal is described. The first banded tonality value is used for approximating a high frequency component of the audio signal based on a low frequency component of the audio signal. The method comprises determining a set of transform coefficients in a corresponding set of frequency bins based on a block of samples of the audio signal; determining a set of bin tonality values for the set of frequency bins using the set of transform coefficients, respectively; and combining a first subset of two or more of the set of bin tonality values for two or more corresponding adjacent frequency bins of the set of frequency bins lying within the first frequency subband, thereby yielding the first banded tonality value for the first frequency subband.

12 Claims, 14 Drawing Sheets

Related U.S. Application Data

Figure 1A:
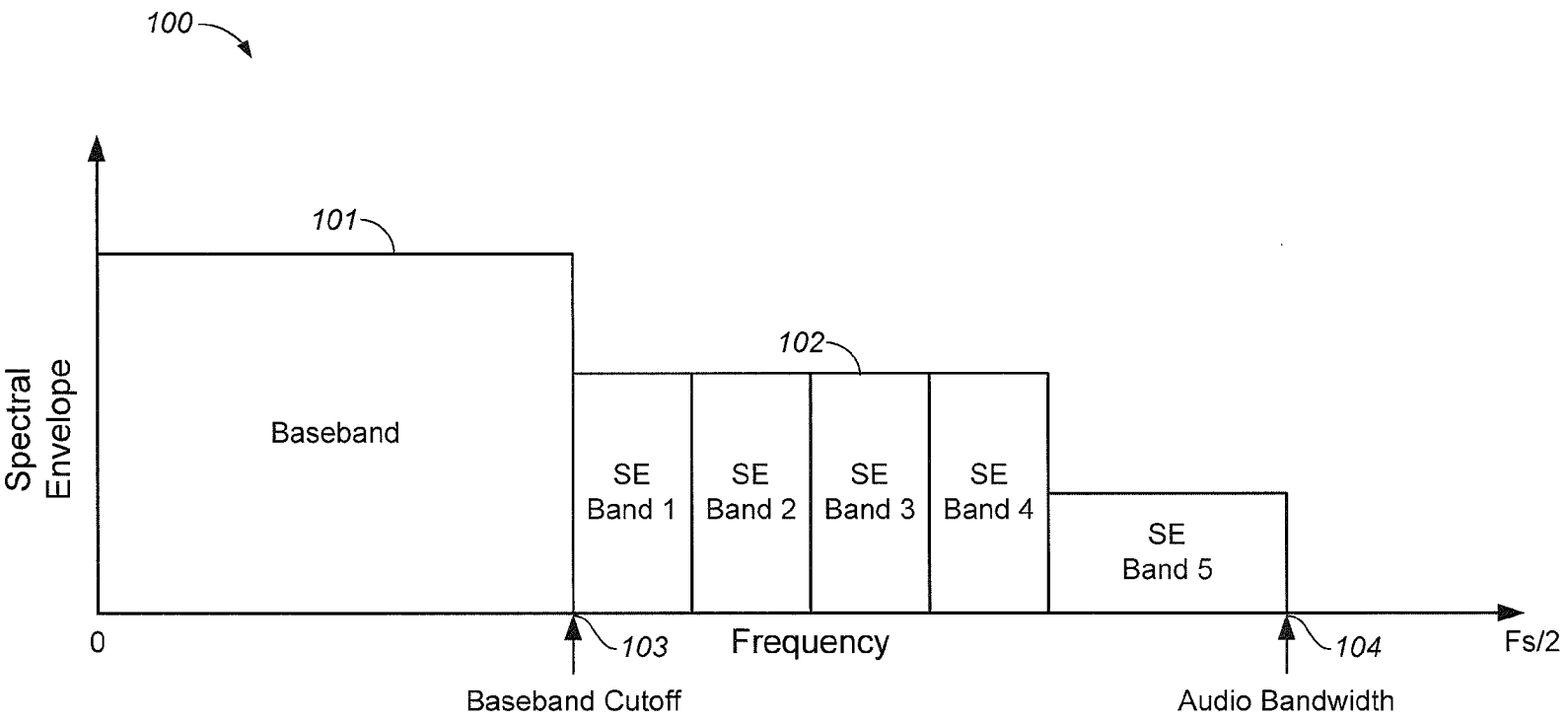

(60) Provisional application No. 61/680,805, filed on Aug. 8, 2012.

(58) Field of Classification Search
USPC ..... 704/500, 501, E21.011; 381/98; 700/94
See application file for complete search history.

(56) References Cited

U.S. PATENT DOCUMENTS

| | | | | |
|---|---|---|---|---|
| 7,439,873 | B2 | 10/2008 | Tillotson | |
| 7,457,744 | B2 | 11/2008 | Lee | |
| 7,630,882 | B2 * | 12/2009 | Mehrotra | G10L 19/0208 704/205 |
| 7,675,873 | B2 | 3/2010 | Krstulich | |
| 8,532,998 | B2 | 9/2013 | Gao | |
| 2005/0096917 | A1 * | 5/2005 | Kjorling | G10L 19/07 704/500 |
| 2007/0200925 | A1 | 8/2007 | Kim | |
| 2009/0080666 | A1 | 3/2009 | Uhle | |
| 2009/0116652 | A1 | 5/2009 | Kirkeby | |
| 2009/0135919 | A1 | 5/2009 | Vered | |
| 2010/0094638 | A1 | 4/2010 | Lee | |
| 2010/0262267 | A1 | 10/2010 | Alexandrov | |
| 2010/0316232 | A1 | 12/2010 | Acero | |
| 2011/0090301 | A1 | 4/2011 | Aaron | |
| 2011/0130131 | A1 | 6/2011 | Hanson | |
| 2011/0182415 | A1 | 7/2011 | Jacobstein | |
| 2011/0254913 | A1 | 10/2011 | Mochida | |
| 2012/0136670 | A1 * | 5/2012 | Ishikawa | G10L 21/038 704/500 |
| 2013/0325457 | A1 | 12/2013 | Oshikiri | |
| 2014/0200901 | A1 * | 7/2014 | Kawashima | G10L 21/0388 704/500 |

FOREIGN PATENT DOCUMENTS

| | | |
|---|---|---|
| CN | 1781141 | 5/2006 |
| JP | 2006-503319 | 1/2006 |
| JP | 2007-187905 | 7/2007 |
| JP | 2008-096567 | 4/2008 |
| JP | 2009-042734 | 2/2009 |
| KR | 10-2009-0052789 | 5/2009 |
| KR | 10-2011-0005865 | 1/2011 |
| RU | 2329550 | 7/2008 |
| RU | 2409899 | 1/2011 |
| WO | 2008/109572 | 9/2008 |
| WO | 2011/059432 | 5/2011 |
| WO | 2011/071610 | 6/2011 |

OTHER PUBLICATIONS

Bello, Juan Pablo, et al "A Tutorial on Onset Detection in Music Signals" IEEE Transactions on Speech and Audio Processing, vol. 13, No. 5, Sep. 2005, pp. 1035-1047.

Bello, Juan Pablo et al "Phase-Based Note Onset Detection for Music Signals" Proc. of International Conference on Acoustics, Speech and Signal Processing, Apr. 6-10, 2003, vol. 5, pp. V441-V444.

* cited by examiner

METHODS AND SYSTEMS FOR EFFICIENT RECOVERY OF HIGH FREQUENCY AUDIO CONTENT

TECHNICAL FIELD OF THE INVENTION

The present document relates to the technical field of audio coding, decoding and processing. It specifically relates to methods of recovering high frequency content of an audio signal from low frequency content of the same audio signal in an efficient manner.

BACKGROUND OF THE INVENTION

Efficient coding and decoding of audio signals often includes reducing the amount of audio-related data to be encoded, transmitted and/or decoded based on psychoacoustic principles. This includes for example discarding so-called masked audio content which is present in an audio signal but not perceivable by a listener. Alternatively or in addition, the bandwidth of an audio signal to be encoded may be limited, while only keeping respectively calculating some information on its higher frequency content without actually encoding such higher frequency content directly. The band-limited signal is then encoded and transmitted (or stored) together with said higher frequency information, the latter requiring less resources than directly encoding also the higher frequency content.

Spectral Band Replication (SBR) in HE-AAC (High Efficiency-Advanced Audio Coding) and Spectral Extension (SPX) in Dolby Digital Plus are two examples for audio coding systems which approximate or reconstruct a high frequency component of an audio signal based on a low frequency component of the audio signal and based on additional side information (also referred to as higher frequency information). In the following, reference is made to the SPX scheme of Dolby Digital Plus. It should be noted, however, that the methods and systems described in the present document are applicable to High Frequency Reconstruction techniques in general, including SBR in HE-AAC.

The determination of the side information in an SPX based audio encoder is typically subject to significant computational complexity. By way of example, the determination of the side information may require around 50% of the total computational resources of the audio encoder. The present document describes methods and systems which allow reducing the computational complexity of SPX based audio encoders. In particular, the present document describes methods and systems which allow reducing the computational complexity for performing tonality calculations in the context of SPX based audio encoders (wherein the tonality calculations may account for around 80% of the computational complexity used for determining the side information).

SUMMARY OF THE INVENTION

According to an aspect a method for determining a first banded tonality value for a first frequency subband of an audio signal is described. The audio signal may be the audio signal of a channel of a multi-channel audio signal (e.g. a stereo, a 5.1 or a 7.1 multi-channel signal). The audio signal may have a bandwidth ranging from a low signal frequency to a high signal frequency. The bandwidth may comprise a low frequency band and a high frequency band. The first frequency subband may lie within the low frequency band or within the high frequency band. The first banded tonality value may be indicative of a tonality of the audio signal within the first frequency band. An audio signal may be considered to have a relatively high tonality within a frequency subband if the frequency subband comprises a relatively high degree of stable sinusoidal content. On the other hand, an audio signal may be considered to have a low tonality within the frequency subband if the frequency subband comprises a relatively high degree of noise. The first banded tonality value may depend on the variation of the phase of the audio signal within the first frequency subband.

The method for determining the first banded tonality value may be used in the context of an encoder of the audio signal. The encoder may make use of high frequency reconstruction techniques, such as Spectral Band Replication (SBR) (as used e.g. in the context of a High Efficiency-Advanced Audio Coder, HE-AAC) or Spectral Extension (SPX) (as used e.g. in the context of a Dolby Digital Plus encoder). The first banded tonality value may be used for approximating a high frequency component (in the high frequency band) of the audio signal based on a low frequency component (in the low frequency band) of the audio signal. In particular, the first banded tonality value may be used to determine side information which may be used by a corresponding audio decoder to reconstruct the high frequency component of the audio signal based on the received (decoded) low frequency component of the audio signal. The side information may e.g. specify an amount of noise to be added to the translated frequency subbands of the low frequency component, in order to approximate a frequency subband of the high frequency component.

The method may comprise determining a set of transform coefficients in a corresponding set of frequency bins based on a block of samples of the audio signal. The sequence of samples of the audio signal may be grouped into a sequence of frames each comprising a pre-determined number of samples. A frame of the sequence of frames may be subdivided into one or more blocks of samples. Adjacent blocks of a frame may overlap (e.g. by up to 50%). A block of samples may be transformed from the time-domain to the frequency-domain using a time-domain to frequency-domain transform, such as a Modified Discrete Cosine Transform (MDCT) and/or a Modified Discrete Sine Transform (MDST), thereby yielding the set of transform coefficients. By applying an MDST and a MDCT to the block of samples, a set of complex transform coefficients may be provided. Typically, the number N of transform coefficients (and the number N of frequency bins) corresponds to the number N of samples within a block (e.g. N=128 or N=256). The first frequency subband may comprise a plurality of the N frequency bins. In other words, the N frequency bins (having a relatively high frequency resolution) may be grouped to one or more frequency subbands (having a relatively lower frequency resolution). As a result, it is possible to provide a reduced number of frequency subbands (which is typically beneficial with respect to reduced data-rates of the encoded audio signal), wherein the frequency subbands have a relatively high frequency selectivity between each other (due to the fact that the frequency subbands are obtained by the grouping of a plurality of high resolution frequency bins).

The method may further comprise determining a set of bin tonality values for the set of frequency bins using the set of transform coefficients, respectively. The bin tonality values are typically determined for an individual frequency bin (using the transform coefficient of this individual frequency bin). As such, a bin tonality value is indicative of the tonality of the audio signal within an individual frequency bin. By way of example, the bin tonality value depends on the variation of the phase of the transform coefficient within the corresponding individual frequency bin.

The method may further comprise combining a first subset of two or more of the set of bin tonality values for two or more corresponding adjacent frequency bins of the set of frequency bins lying within the first frequency subband, thereby yielding the first banded tonality value for the first frequency subband. In other words, the first banded tonality value may be determined by combining two or more bin tonality values for the two or more frequency bins lying within the first frequency subband. The combining of the first subset of two or more of the set of bin tonality values may comprise averaging of the two or more bin tonality values and/or summing up of the two or more bin tonality values. By way of example, the first banded tonality value may be determined based on the sum of the bin tonality values of the frequency bins lying within the first frequency subband.

As such, the method for determining the first banded tonality value specifies the determination of the first banded tonality value within the first frequency subband (comprising a plurality of frequency bins), based on the bin tonality values of the frequency bins lying within the first frequency subbands. In other words, it is proposed to determined the first banded tonality value in two-steps, wherein the first step provides a set of bin tonality values and wherein the second step combines (at least some of) the set of bin tonality values to yield the first banded tonality value. As a result of such two-step approach, it is possible to determine different banded tonality values (for different subband structures) based on the same set of bin tonality values, thereby reducing the computational complexity of an audio encoder which makes use of the different banded tonality values.

In an embodiment, the method further comprises determining a second banded tonality value in a second frequency subband by combining a second subset of two or more of the set of bin tonality values for two or more corresponding adjacent frequency bins of the set of frequency bins lying within the second frequency subband. The first and second frequency subbands may comprise at least one common frequency bin and the first and second subsets may comprise the corresponding at least one common bin tonality value. In other words, the first and second banded tonality values may be determined based on at least one common bin tonality value, thereby allowing for a reduced computational complexity linked to the determination of the banded tonality values. By way of example, the first and second frequency subbands may lie within the high frequency band of the audio signal. The first frequency subband may be narrower than the second frequency subband and may lie within the second frequency subband. The first tonality value may be used in the context of Large Variance Attenuation of an SPX based encoder and the second tonality value may be used in the context of noise blending of the SPX based encoder.

As indicated above, the methods described herein are typically used in the context of an audio encoder making use of high frequency reconstruction (HFR) techniques. Such HFR techniques typically translate one or more frequency bins from the low frequency band of the audio signal to one or more frequency bins from the high frequency band, in order to approximate the high frequency component of the audio signal. As such, approximating the high frequency component of the audio signal based on the low frequency component of the audio signal may comprise copying one or more low frequency transform coefficients of one or more frequency bins from the low frequency band corresponding to the low frequency component to the high frequency band corresponding to the high frequency component of the audio signal. This pre-determined copying process may be taken into account when determining banded tonality values. In particular, it may be taken into account that bin tonality values are typically not affected by the copying process, thereby allowing bin tonality values which have been determined for a frequency bin within the low frequency band to be used for corresponding copied frequency bins within the high frequency band.

In an embodiment, the first frequency subband lies within the low frequency band and the second frequency subband lies within the high frequency band. The method may further comprise determining the second banded tonality value in the second frequency subband by combining a second subset of two or more of the set of bin tonality values for two or more corresponding frequency bins of the frequency bins which have been copied to the second frequency subband. In other words, the second banded tonality value (for the second frequency subband lying within the high frequency band) may be determined based on the bin tonality values of the frequency bins which have been copied up to the high frequency band. The second frequency subband may comprise at least one frequency bin that has been copied from a frequency bin lying within first frequency band. As such, the first and second subsets may comprise the corresponding at least one common bin tonality value, thereby reducing the computational complexity linked to the determination of banded tonality values.

As indicated above, the audio signal is typically grouped into a sequence of blocks (comprising e.g. N samples each). The method may comprise determining a sequence of sets of transform coefficients based on the corresponding sequence of blocks of the audio signal. As a result, for each frequency bin, a sequence of transform coefficients may be determined. In other words, for a particular frequency bin, the sequence of sets of transform coefficients may comprise a sequence of particular transform coefficients. The sequence of particular transform coefficients may be used to determine a sequence of bin tonality values for the particular frequency bin for the sequence of blocks of the audio signal.

Determining the bin tonality value for the particular frequency bin may comprise determining a sequence of phases based on the sequence of particular transform coefficients and determining a phase acceleration based on the sequence of phases. The bin tonality value for the particular frequency bin is typically a function of the phase acceleration. By way of example, the bin tonality value for a current block of the audio signal may be determined based on a current phase acceleration. The current phase acceleration may be determined based on the current phase (determined based on the transform coefficient of the current block) and based on two or more preceding phases (determined based on two or more transform coefficients of the two or more preceding blocks). As indicated above, a bin tonality value for a particular frequency bin is typically determined only based on the transform coefficients of the same particular frequency bin. In other words, the bin tonality value for a frequency bin is typically independent from the bin tonality values of other frequency bins.

As already outlined above, the first banded tonality value may be used for approximating a high frequency component of the audio signal based on a low frequency component of the audio signal using a Spectral Extension (SPX) scheme. The first banded tonality value may be used to determine an SPX coordinate resend strategy, a noise blending factor and/or a Large Variance Attenuation.

According to another aspect, a method for determining a noise blending factor is described. It should be noted that the different aspects and methods described in the present document may be combined with one another in an arbitrary way. The noise blending factor may be used for approximating a high frequency component of the audio signal based on a low frequency component of the audio signal. As outlined above, the high frequency component typically comprises components of the audio signal in the high frequency band. The high frequency band may be subdivided into one or more high frequency subbands (e.g. the first and/or second frequency subbands described above). The component of the audio signal within a high frequency subband may be referred to as a high frequency subband signal. In a similar manner, the low frequency component typically comprises components of the audio signal in the low frequency band and the low frequency band may be subdivided into one or more low frequency subbands (e.g. the first and/or second frequency subbands described above). The component of the audio signal within a low frequency subband may be referred to as a low frequency subband signal. In other words, the high frequency component may comprise one or more (original) high frequency subband signals in the high frequency band and the low frequency component may comprise one or more low frequency subband signals in the low frequency band.

As outlined above, approximating the high frequency component may comprise copying one or more low frequency subband signals to the high frequency band, thereby yielding one or more approximated high frequency subband signals. The noise blending factor may be used to indicate an amount of noise which is to be added to the one or more approximated high frequency subband signals in order to align the tonality of the approximated high frequency subband signals with the tonality of the original high frequency subband signal of the audio signal. In other words, the noise blending factor may be indicative of an amount of noise to be added to the one or more approximated high frequency subband signals, in order to approximate the (original) high frequency component of the audio signal.

The method may comprise determining a target banded tonality value based on the one or more (original) high frequency subband signals. Furthermore, the method may comprise determining a source banded tonality value based on the one or more approximated high frequency subband signals. The tonality values may be indicative of the evolution of the phase of the respective subband signals. Furthermore, the tonality values may be determined as described in the present document. In particular, the banded tonality values may be determined based on the two-step approach outlined in the present document, i.e. the banded tonality values may be determined based on a set of bin tonality values.

The method may further comprise determining the noise blending factor based on the target and source banded tonality values. In particular, the method may comprise determining the noise blending factor based on the source banded tonality value, if the bandwidth of the to-be-approximated high frequency component is smaller than the bandwidth of the low frequency component which is used to approximate the high frequency component. As a result, the computational complexity for determining the noise blending factor can be reduced compared to a method where the noise blending factor is determined based on a banded tonality value which is derived from the low frequency component of the audio signal.

In an embodiment, the low frequency band comprises a start band (indicated e.g. by the spxstart parameter in the case of an SPX based encoder) which is indicative of the low frequency subband having the lowest frequency among the low frequency subbands which are available for copying. Furthermore, the high frequency band may comprise a begin band (indicated e.g. by the spxbegin parameter in the case of an SPX based encoder) which is indicative of the high frequency subband having the lowest frequency of the high frequency subbands which are to be approximated. In addition, the high frequency band may comprise an end band (indicated e.g. by the spxend parameter in the case of an SPX based encoder) which is indicative of the high frequency subband having the highest frequency of the high frequency subbands which are to be approximated.

The method may comprise determining a first bandwidth between the start band (e.g. the spxstart parameter) and the begin band (e.g. the spxbegin parameter). Furthermore, the method may comprise determining a second bandwidth between the begin band (e.g. the spxbegin parameter) and the end band (e.g. spxend parameter). The method may comprise determining the noise blending factor based on the target and source banded tonality values, if the first bandwidth is greater than the second bandwidth. In particular, if the first bandwidth is greater than or equal to the second bandwidth, the source banded tonality value may be determined based on the one or more low frequency subband signals of the low frequency subband lying between the start band and the start band plus the second bandwidth. Typically, the latter low frequency subband signals are the low frequency subband signals which are copied up to the high frequency band. As a result, the computational complexity can be reduced in situations where the first bandwidth is greater than or equal to the second bandwidth.

On the other hand, the method may comprise determining a low banded tonality value based on the one or more low frequency subband signals of the low frequency subband between the start band and the begin band, and determining the noise blending factor based on the target and the low banded tonality values, if the first bandwidth is smaller than the second bandwidth. By comparing the first and second bandwidths, it can be ensured that the noise blending factor (and the banded tonality values) are determined on a minimum number of subbands (regardless the first and second bandwidths), thereby reducing the computational complexity.

The noise blending factor may be determined based on a variance of the target and source banded tonality values (or the target and low banded tonality values). In particular, the noise blending factor b may be determined as $$b=T_{copy}\cdot(1-\mathrm{var}\{T_{copy},T_{high}\})+T_{high}\cdot(\mathrm{var}\{T_{copy},T_{high}\}),$$

where $$\mathrm{var}\{T_{copy},\ T_{high}\}=\left(\frac{T_{copy}-T_{high}}{T_{copy}+T_{high}}\right)^2$$

is the variance of the source tonality value $T_{copy}$ (or of the low tonality value) and the target tonality value $T_{high}$.

As indicated above, the (source, target or low) banded tonality values may be determined using the two-step approach described in the present document. In particular, a banded tonality value in a frequency subband may be determined by determining a set of transform coefficients in a corresponding set of frequency bins based on a block of samples of the audio signal. Subsequently, a set of bin tonality values for the set of frequency bins may be determined using the set of transform coefficients, respectively. The banded tonality value of the frequency subband may then be determined by combining a first subset of two or more of the set of bin tonality values for two or more corresponding adjacent frequency bins of the set of frequency bins lying within the frequency subband.

According to a further aspect, a method for determining a first bin tonality value for a first frequency bin of an audio signal is described. The first bin tonality value may be determined in accordance to the principles described in the present document. In particular, the first bin tonality value may be determined based on a variation of the phase of the transform coefficient of the first frequency bin. Furthermore, as has also outlined in the present document, the first bin tonality value may be used for approximating a high frequency component of the audio signal based on a low frequency component of the audio signal. As such, the method for determining a first bin tonality value may be used in the context of an audio encoder using HFR techniques.

The method may comprise providing a sequence of transform coefficients in the first frequency bin for a corresponding sequence of blocks of samples of the audio signal. The sequence of transform coefficients may be determined by applying a time-domain to frequency-domain transform to the sequence of blocks of samples (as described above). Furthermore, the method may comprise determining a sequence of phases based on the sequence of transform coefficients. The transform coefficient may be complex and a phase of a transform coefficient may be determined based on an arctangent function applied to the real and imaginary part of the complex transform coefficient. Furthermore, the method may comprise determining a phase acceleration based on the sequence of phases. By way of example, the current phase acceleration for a current transform coefficient for a current block of samples may be determined based on the current phase and based on two or more preceding phases. In addition, the method may comprise determining a bin power based on the current transform coefficient from the sequence of transform coefficients. The power of the current transform coefficient may be based on a squared magnitude of the current transform coefficient.

The method may further comprise approximating a weighting factor indicative of the fourth root of a ratio of a power of succeeding transform coefficients using a logarithmic approximation. The method may then proceed in weighting the phase acceleration by the approximated weighting factor and/or by the power of the current transform coefficient to yield the first bin tonality value. As a result of approximating the weighting factor using a logarithmic approximation, a high quality approximation of the correct weighting factor can be achieved, while at the same time significantly reducing the computational complexity compared to the determination of the exact weighting factor which involves the determination of a fourth root of the ratio of the power of succeeding transform coefficients. The logarithmic approximation may comprise the approximation of a logarithmic function by a linear function and/or by a polynomial (e.g. of order 1, 2, 3, 4 or 5).

The sequence of transform coefficients may comprise a current transform coefficient (for a current block of samples) and a directly preceding transform coefficient (for a directly preceding block of samples). The weighting factor may be indicative of the fourth root of a ratio of the power of the current transform coefficient and the directly preceding transform coefficient. Furthermore, as indicated above, the transform coefficients may be complex numbers comprising a real part and an imaginary part. The power of the current (preceding) transform coefficient may be determined based on the squared real part and the squared imaginary part of the current (preceding) transform coefficient. In addition, a current (preceding) phase may be determined based on an arctangent function of the real part and the imaginary part of the current (preceding) transform coefficient. A current phase acceleration may be determined based on the phase of the current transform coefficient and based on the phases of two or more directly preceding transform coefficients.

Approximating the weighting factor may comprise providing a current mantissa and a current exponent representing a current one of the sequence of succeeding transform coefficients. Furthermore, approximating the weighting factor may comprise determining an index value for a predetermined lookup table based on the current mantissa and the current exponent. The lookup table typically provides a relationship between a plurality of index values and a corresponding plurality of exponential values of the plurality of index values. As such, the lookup table may provide an efficient means for approximating an exponential function. In an embodiment, the lookup table comprises 64 or less entries (i.e. pairs of index values and exponential values). The approximated weighting factor may be determined using the index value and the lookup table.

In particular, the method may comprise determining a real valued index value based on the mantissa and the exponent. An (integer valued) index value may then be determined by truncating and/or rounding the real valued index value. As a result of a systematic truncation or rounding operation, a systematic offset may be introduced into the approximation. Such systematic offset may be beneficial with regards to the perceived quality of an audio signal which is encoded using the method for determining the bin tonality value described in the present document.

Approximating the weighting factor may further comprise providing a preceding mantissa and a preceding exponent representing a transform coefficient preceding the current transform coefficient. The index value may then be determined based on one or more add and/or subtract operations applied to the current mantissa, the preceding mantissa, the current exponent and the preceding exponent. In particular, the index value may be determined by performing a modulo operation on $(e_y-e_z+2\cdot m_y-2\cdot m_z)$, with $e_y$ being the current mantissa, $e_z$ being the preceding mantissa, $m_y$ being the current exponent and $m_z$ being the preceding exponent.

As indicated above, the methods described in the present document are applicable to multi-channel audio signals. In particular, the methods are applicable to a channel of a multi-channel audio signal. Audio encoders for multi-channel audio signals typically apply a coding technique referred to as channel coupling (of briefly coupling), in order to jointly encode a plurality of channels of the multi-channel audio signal. In view of this, according to an aspect, a method for determining a plurality of tonality values for a plurality of coupled channels of a multi-channel audio signal is described.

The method may comprise determining a first sequence of transform coefficients for a corresponding sequence of blocks of samples of a first channel of the plurality of coupled channels. Alternatively, the first sequence of transform coefficients may be determined based on a sequence of blocks of samples of the coupling channel derived from the plurality of coupled channels. The method may proceed in determining a first tonality value for the first channel (or for the coupling channel). For this purpose, the method may comprise determining a first sequence of phases based on the sequence of first transform coefficients and determining a first phase acceleration based on the sequence of first phases. The first tonality value for the first channel (or for the coupling channel) may then be determined based on the first phase acceleration. Furthermore, the tonality value for a second channel of the plurality of coupled channels may be determined based on the first phase acceleration. As such, the tonality values for the plurality of coupled channels may be determined based on the phase acceleration determined from only a single one of the coupled channels, thereby reducing the computational complexity linked to the determination of tonality. This is possible due to the observation that, as a result of coupling, the phases of the plurality of coupled channels are aligned.

According to another aspect, a method for determining a banded tonality value for a first channel of a multi-channel audio signal in a Spectral Extension (SPX) based encoder is described. The SPX based encoder may be configured to approximate a high frequency component of the first channel from a low frequency component of the first channel. For this purpose, the SPX based encoder may make use of the banded tonality value. In particular, the SPX based encoder may use the banded tonality value for determining a noise blending factor indicative of an amount of noise to be added to the approximated high frequency component. As such, the banded tonality value may be indicative of the tonality of an approximated high frequency component prior to noise blending. The first channel may be coupled by the SPX based encoder with one or more other channels of the multi-channel audio signal.

The method may comprise providing a plurality of transform coefficients based on the first channel prior to coupling. Furthermore, the method may comprise determining the banded tonality value based on the plurality of transform coefficients. As such, the noise blending factor may be determined based on the plurality of transform coefficients of the original first channel, and not based on the coupled/decoupled first channel. This is beneficial, as this allows to reduce the computational complexity linked to the determination of tonality in an SPX based audio encoder.

As outlined above, the plurality of transform coefficients which have been determined based on the first channel prior to coupling (i.e. based on the original first channel) may be used to determine bin tonality values and/or banded tonality values which are used for determining the SPX coordinate resend strategy and/or for determining the Large Variance Attenuation (LVA) of an SPX based encoder. By using the above mentioned approach for determining the noise blending factor of the first channel based on the original first channel (and not based on the coupled/decoupled first channel), the bin tonality values which have already been determined for the SPX coordinate resend strategy and/or for the Large Variance Attenuation (LVA) can be re-used, thereby reducing the computational complexity of the SPX based encoder.

According to another aspect, a system configured to determine a first banded tonality value for a first frequency subband of an audio signal is described. The first banded tonality value may be used for approximating a high frequency component of the audio signal based on a low frequency component of the audio signal. The system may be configured to determine a set of transform coefficients in a corresponding set of frequency bins based on a block of samples of the audio signal. Furthermore, the system may be configured to determine a set of bin tonality values for the set of frequency bins using the set of transform coefficients, respectively. In addition, the system may be configured to combine a first subset of two or more of the set of bin tonality values for two or more corresponding adjacent frequency bins of the set of frequency bins lying within the first frequency subband, thereby yielding the first banded tonality value for the first frequency subband.

According to another aspect, a system configured to determine a noise blending factor is described. The noise blending factor may be used for approximating a high frequency component of the audio signal based on a low frequency component of the audio signal. The high frequency component typically comprises one or more high frequency subband signals in a high frequency band and the low frequency component typically comprises one or more low frequency subband signals in a low frequency band. Approximating the high frequency component may comprise copying one or more low frequency subband signals to the high frequency band, thereby yielding one or more approximated high frequency subband signals. The system may be configured to determine a target banded tonality value based on the one or more high frequency subband signals. Furthermore, the system may be configured to determine a source banded tonality value based on the one or more approximated high frequency subband signals. In addition, the system may be configured to determine the noise blending factor based on the target (322) and source (323) banded tonality values.

According to a further aspect, a system configured to determine a first bin tonality value for a first frequency bin of an audio signal is described. The first banded tonality value may be used for approximating a high frequency component of the audio signal based on a low frequency component of the audio signal. The system may be configured to provide a sequence of transform coefficients in the first frequency bin for a corresponding sequence of blocks of samples of the audio signal. Furthermore, the system may be configured to determine a sequence of phases based on the sequence of transform coefficients, and to determine a phase acceleration based on the sequence of phases. In addition, the system may be configured to approximate a weighting factor indicative of the fourth root of a ratio of a power of succeeding transform coefficients using a logarithmic approximation, and to weight the phase acceleration by the approximated weighting factor to yield the first bin tonality value.

According to another aspect, an audio encoder (e.g. a HFR based audio encoder, in particular an SPX based audio encoder) configured to encode an audio signal using high frequency reconstruction is described. The audio encoder may comprise any one or more of the systems described in the present document. Alternatively or in addition, the audio encoder may be configured to perform any one or more of the methods described in the present document.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

Figure 4:
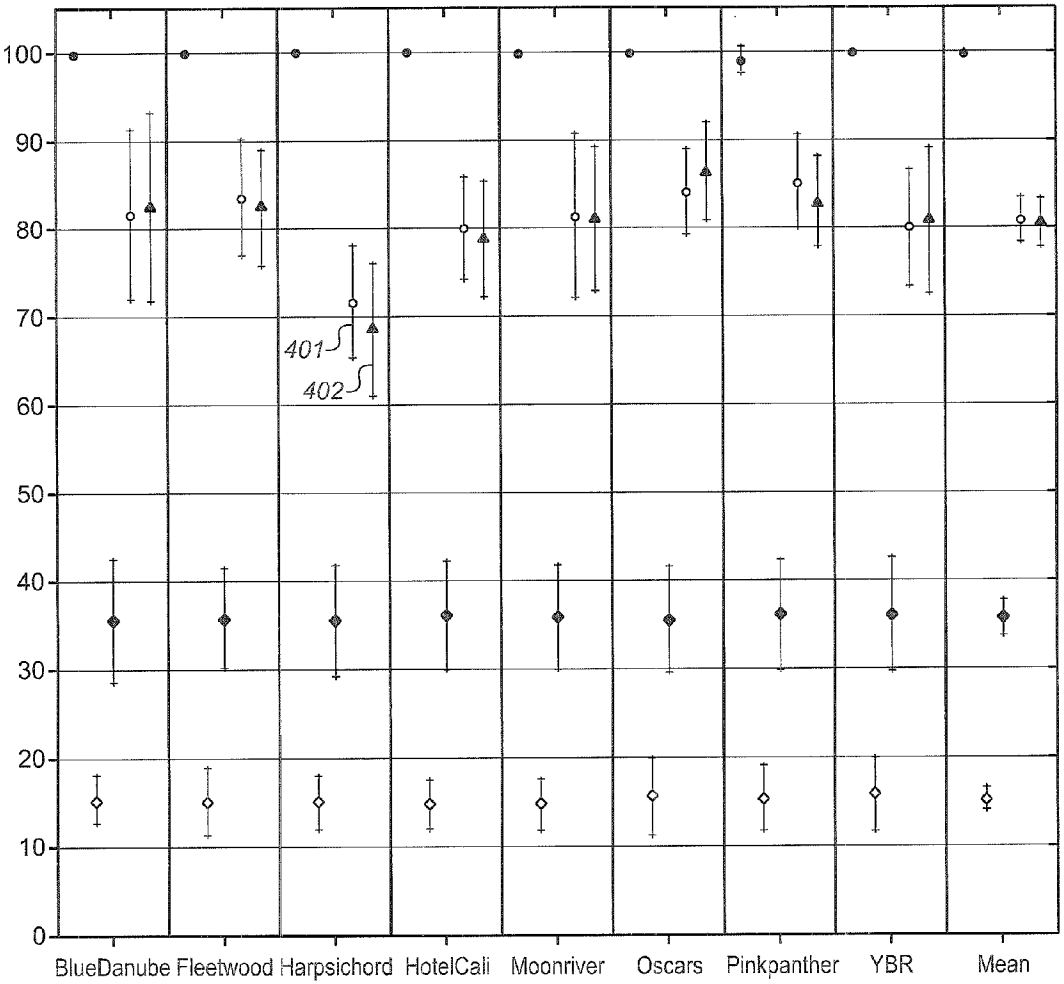
Figure 5A:
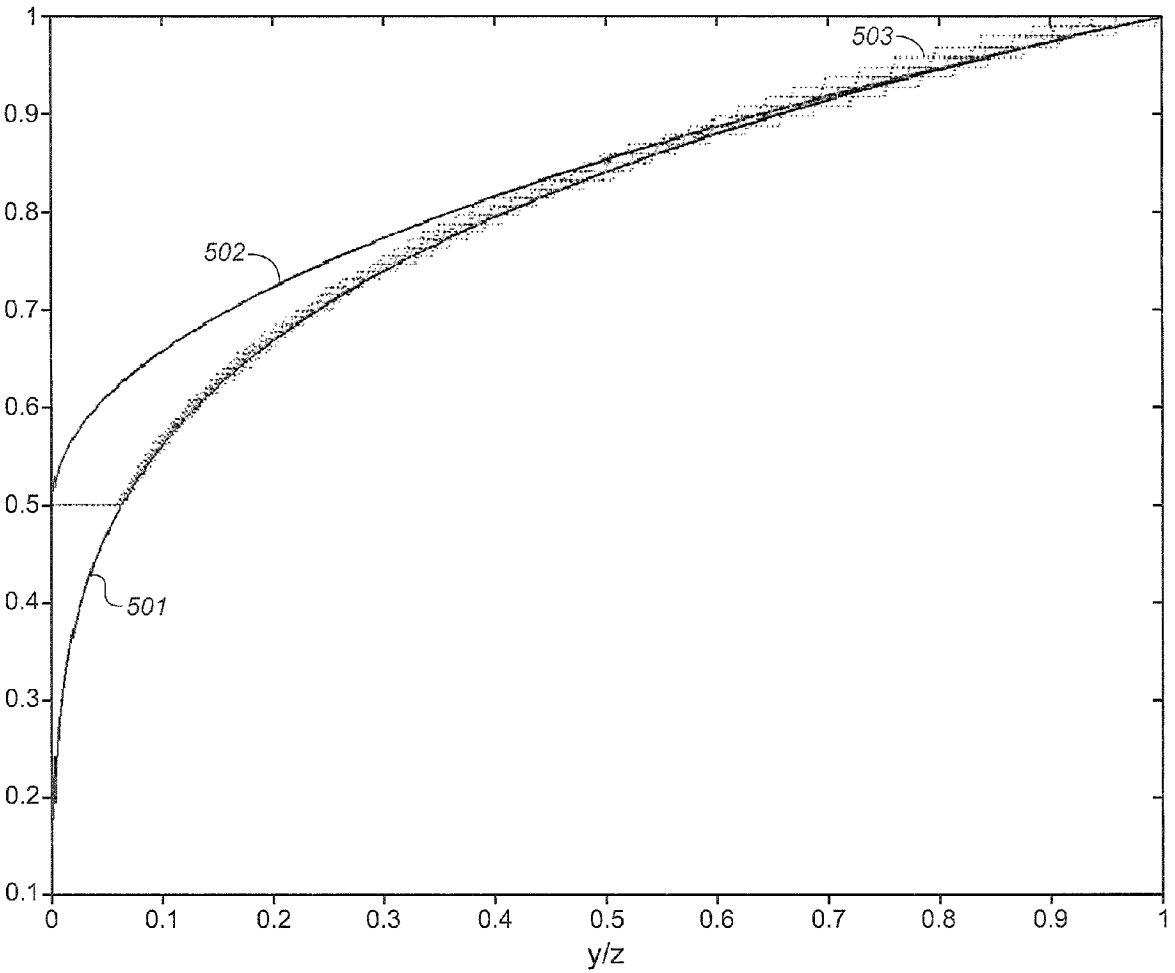
Figure 5B:
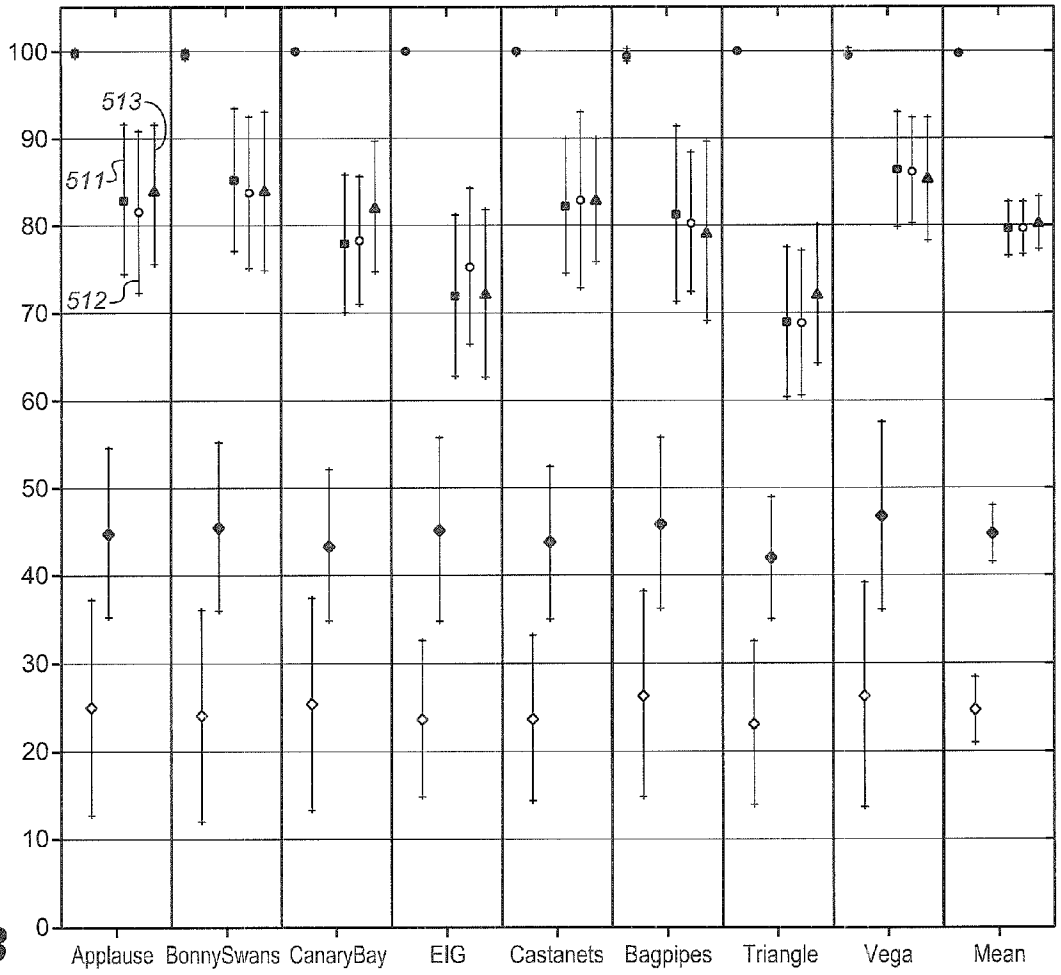

The invention is explained below in an exemplary manner with reference to the accompanying drawings, wherein FIGS. 1*a*, 1*b*, 1*c*, and 1*d* illustrate an example SPX scheme;

FIGS. 2*a*, 2*b*, 2*c*, and 2*d* illustrate the use of tonality at various stages of an SPX based encoder;

FIGS. 3*a*, 3*b*, 3*c*, and 3*d* illustrate example schemes for reducing the computational effort related to the computation of tonality values;

FIG. 4 illustrates example results of a listening test comparing the determination of tonality based on the original audio signal and the determination of tonality based on the de-coupled audio signal;

FIG. 5*a* illustrates example results of a listening test comparing various schemes for determining the weighting factor used for the calculation of tonality values; and FIG. 5*b* illustrates example degrees of approximation of the weighting factor used for the calculation of tonality values.

DETAILED DESCRIPTION OF THE INVENTION

FIGS. 1*a*, 1*b*, 1*c* and 1*d* illustrate example steps performed by an SPX based audio encoder. FIG. 1*a* shows the frequency spectrum 100 of an example audio signal, wherein the frequency spectrum 100 comprises a baseband 101 (also referred to as low frequency band 101) and a high frequency band 102. In the illustrated example, the high frequency band 102 comprises a plurality of subbands, i.e. SE Band 1 up to SE Band 5 (SE, Spectral Extension). The baseband 101 comprises the lower frequencies up to the baseband cutoff frequency 103 and the high frequency band 102 comprises the high frequencies from the baseband cutoff frequency 103 up to the audio bandwidth frequency 104. The baseband 101 corresponds to the spectrum of a low frequency component of the audio signal and the high frequency band 102 corresponds to the spectrum of a high frequency component of the audio signal. In other words, the low frequency component of the audio signal comprises the frequencies within the baseband 101, wherein the high frequency component of the audio signal comprises the frequencies within the high frequency band 102.

An audio encoder typically makes use of a time-domain to frequency-domain transform (e.g. a Modified Discrete Cosine Transform, MDCT and/or a Modified Discrete Sine Transform, MDST) in order to determine the spectrum 100 from the time-domain audio signal. A time-domain audio signal may be subdivided into a sequence of audio frames comprising respective sequences of samples of the audio signal. Each audio frame may be subdivided into a plurality of blocks (e.g. a plurality of up to six blocks), each block comprising e.g. N or 2N samples of the audio signal. The plurality of blocks of a frame may overlap (e.g. by an overlap of 50%), i.e. a second block may comprise a certain number of samples at its beginning, which are identical to the samples at the end of a directly preceding first block. By way of example, a second block of 2N samples may comprise a core section of N samples, and rear/front sections of N/2 samples which overlap with the core section of the directly preceding first block and a directly succeeding third block, respectively. The time-domain to frequency-domain transform of a block of N (or 2/V) samples of the time-domain audio signal typically provides a set of N transform coefficients (TC) for a corresponding set of frequency bins (e.g. N=256). By way of example, the time-domain to frequency-domain transform (e.g. an MDCT or an MDST) of a block of 2N samples, having a core section of N samples and overlapping rear/front sections of N/2 samples, may provide a set of N TCs. As such, an overlap of 50% may result in a 1:1 relation of time-domain samples and TCs on average, thereby yielding a critically sampled system. The subbands of the high frequency band 102 shown in FIG. 1*a* may be obtained by grouping M frequency bins to form a subband (e.g. M=12). In other words, a subband of the high frequency band 102 may comprise or encompass M frequency bins. The spectral energy of a subband may be determined based on the TCs of the M frequency bins forming the subband. By way of example, the spectral energy of the subband may be determined based on the sum of the squared magnitude of the TCs of the M frequency bins forming the subband (e.g. based on the average of the squared magnitude of the TCs of the M frequency bins forming the subband). In particular, the sum of the squared magnitude of the TCs of the M frequency bins forming the subband may yield the subband power, and the subband power divided by the number M of frequency bins may yield the power spectral density (PSD). As such, the baseband 101 and/or the high frequency band 102 may comprise a plurality of subbands, wherein the subbands are derived from a plurality of frequency bins, respectively.

As indicated above, an SPX based encoder approximates the high frequency band 102 of an audio signal by the baseband 101 of the audio signal. For this purpose, the SPX based encoder determines side information which allows a corresponding decoder to reconstruct the high frequency band 102 from the encoded and decoded baseband 101 of the audio signal. The side information typically comprises indicators of the spectral energy of the one or more subbands of the high frequency band 102 (e.g. one or more energy ratios for the one or more subbands of the high frequency band 102, respectively). Furthermore, the side information typically comprises indicators of an amount of noise which is to be added to the one or more subbands of the high frequency band 102 (referred to as noise blending). The latter indicators are typically related to the tonality of the one or more subbands of the high frequency band 102. In other words, the indicators of an amount of noise which is to be added to the one or more subbands of the high frequency band 102 typically makes use of the calculation of tonality values of the one or more subbands of the high frequency band 102.

Figure 1B:
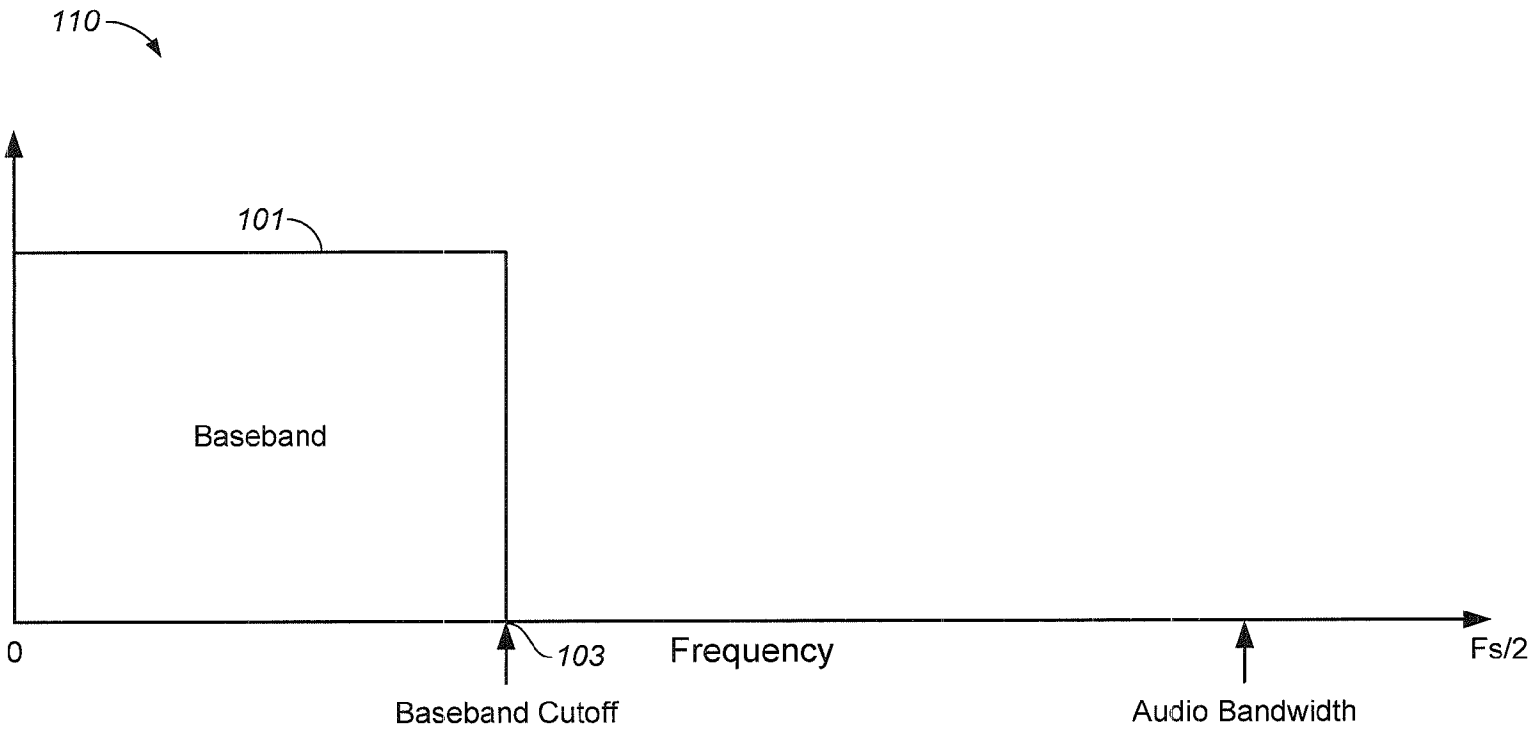
Figure 1C:
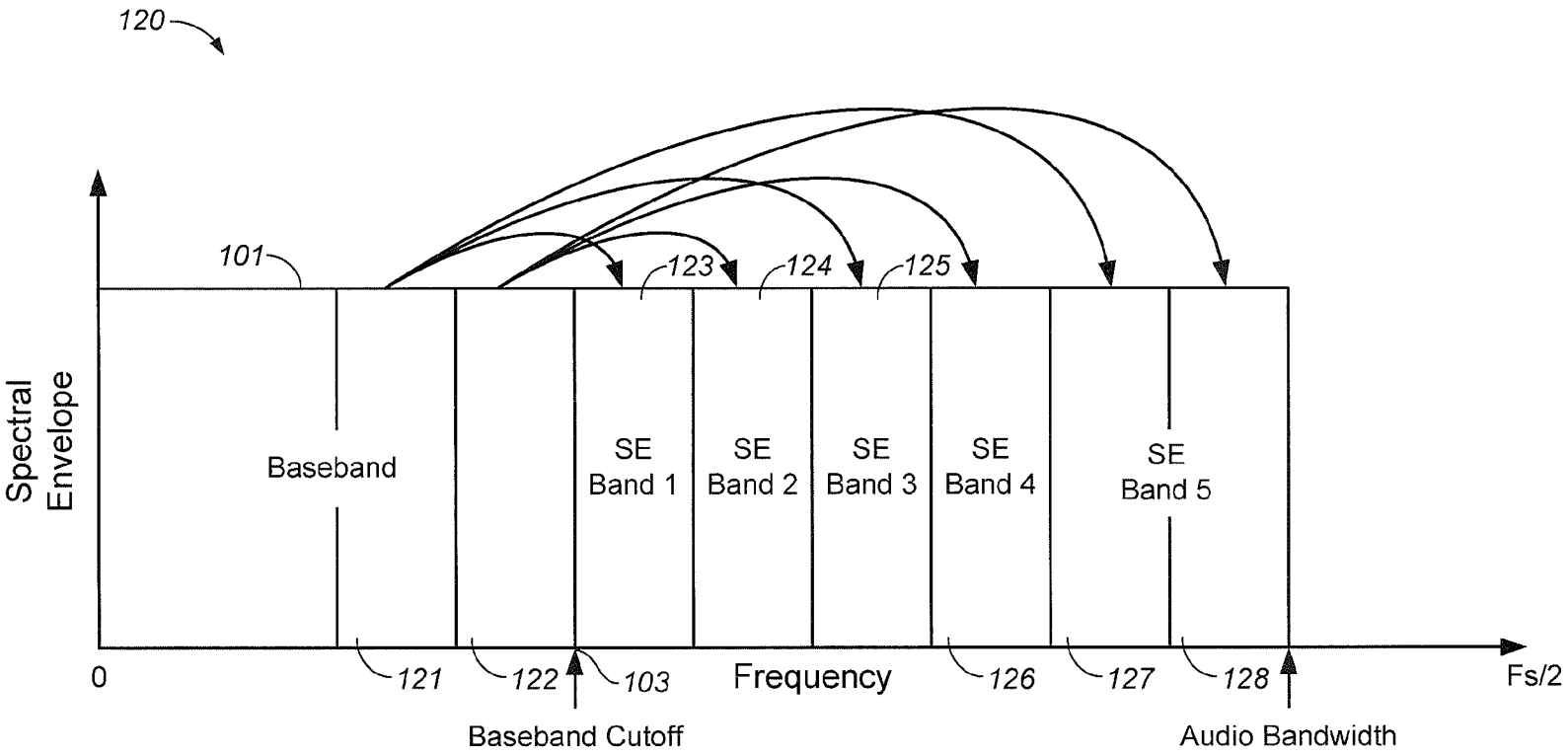
Figure 1D:
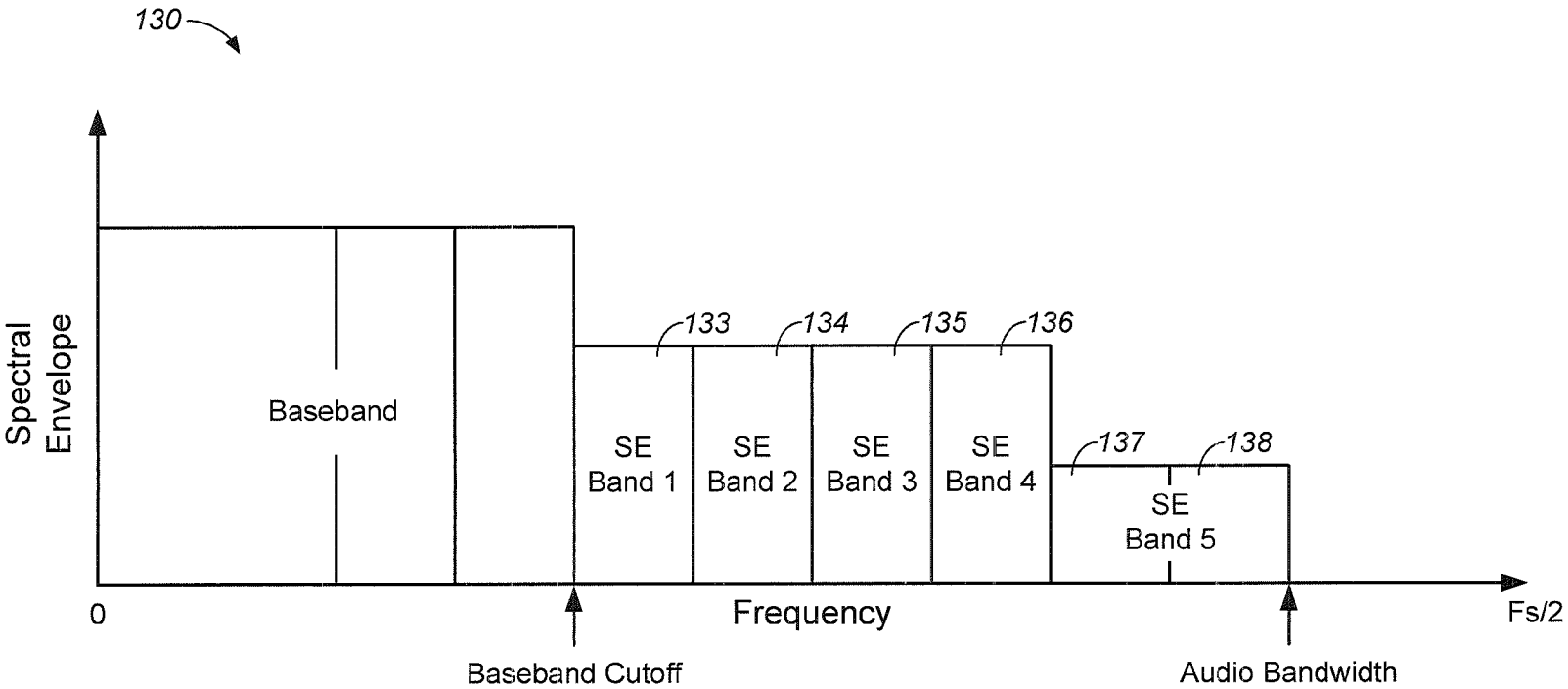

FIGS. 1*b*, 1*c* and 1*d* illustrate the example steps for approximating the high frequency band 102 based on the baseband 101. FIG. 1*b* shows the spectrum 110 of the low frequency component of the audio signal comprising only the baseband 101. FIG. 1*c* illustrates the spectral translation of one or more subbands 121, 122 of the baseband 101 to the frequencies of the high frequency band 102. It can be seen from the spectrum 120 that the subbands 121, 122 are copied to respective frequency bands 123, 124, 125, 126, 127 and 128 of the high frequency band 102. In the illustrated example, the subbands 121, 122 are copied three times, in order to fill up the high frequency band 102. FIG. 1*d* shows how the original high frequency band 102 of the audio signal (see FIG. 1*a*) is approximated based on the copied (or translated) subbands 123, 124, 125, 126, 127 and 128. The SPX based audio encoder may add random noise to the copied subbands, such that the tonality of the approximated subbands 133, 134, 135, 136, 137 and 138 corresponds to the tonality of the original subbands of the high frequency band 102. This may be achieved by determining appropriate respective tonality indicators. Furthermore, the energy of the copied (and noise blended) subbands 123, 124, 125, 126, 127 and 128 may be modified such that the energy of the approximated subbands 133, 134, 135, 136, 137 and 138 corresponds to the energy of the original subbands of the high frequency band 102. This may be achieved by determining appropriate respective energy indicators. It can be seen that as a result, the spectrum 130 approximates the spectrum 100 of the original audio signal shown in FIG. 1*a*.

As indicated above, the determination of the indicators which are used for noise blending (and which typically require the determination of the tonality of the subbands) has a major impact on the computational complexity of the SPX based audio encoder. In particular, tonality values of different signal segments (frequency subbands) may be required for a variety of purposes at different stages of the SPX encoding process. An overview of stages which typically require the determination of tonality values is shown in FIGS. 2*a*, 2*b*, 2*c* and 2*d*.

Figure 2A:
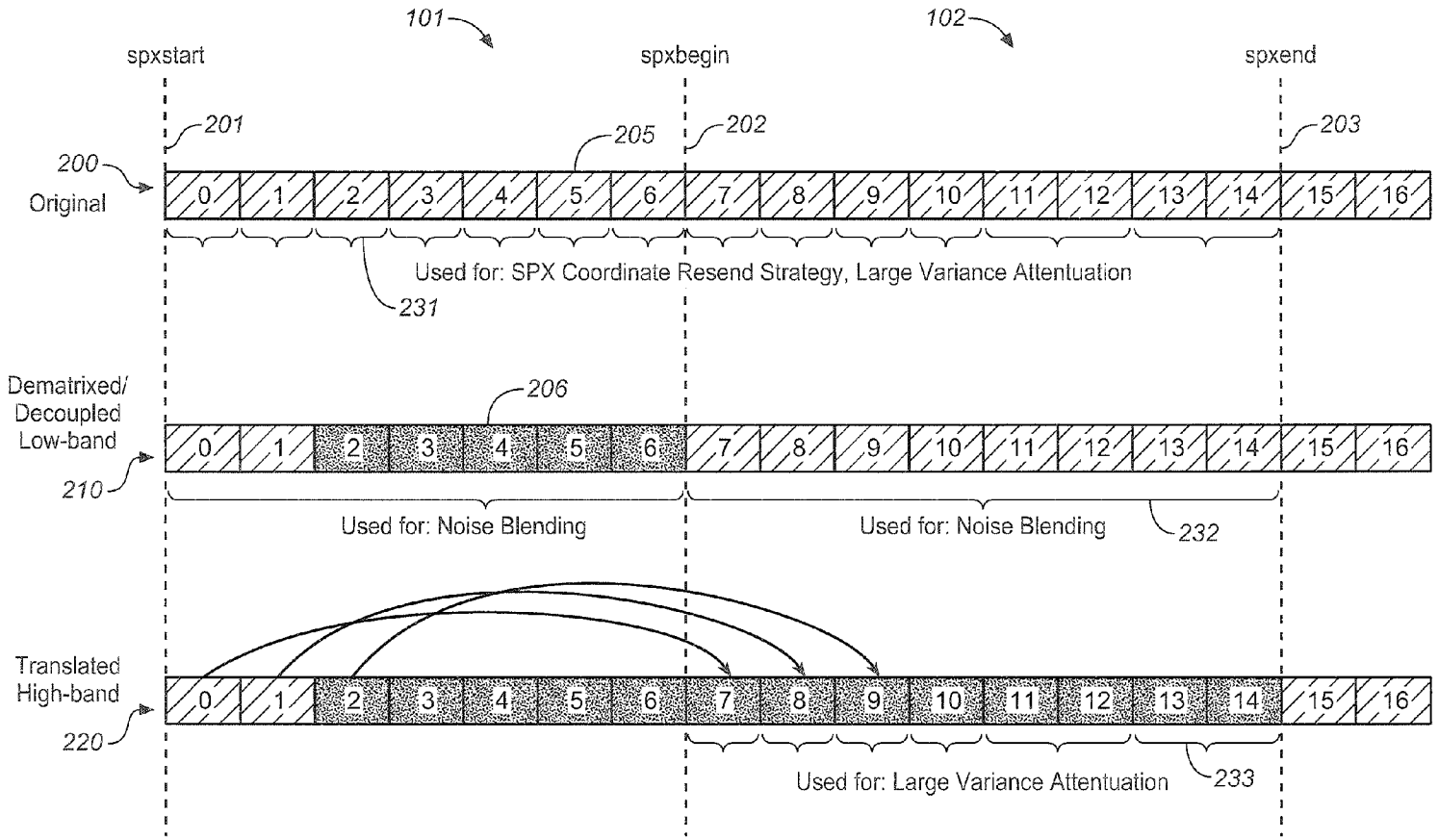
Figure 2B:
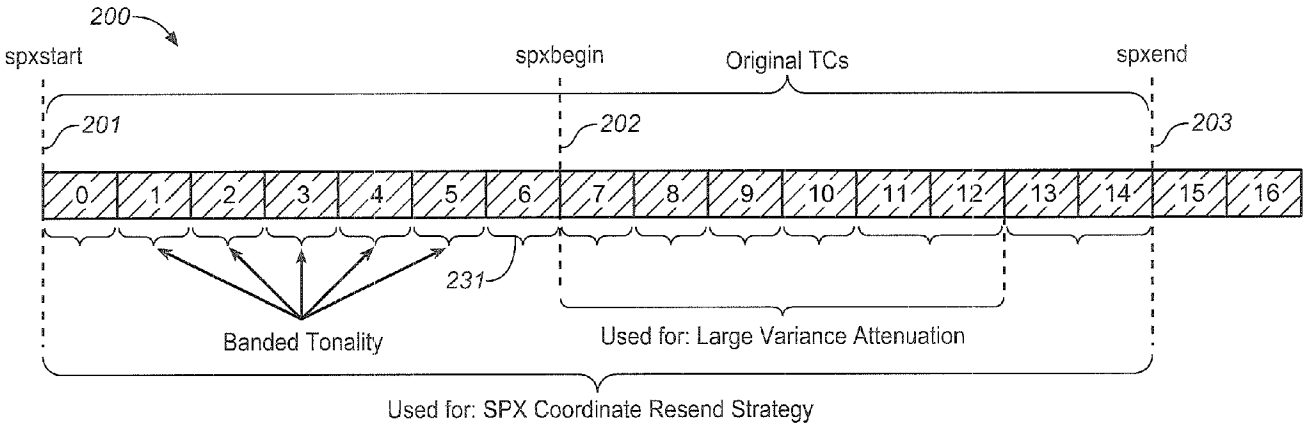
Figure 2C:
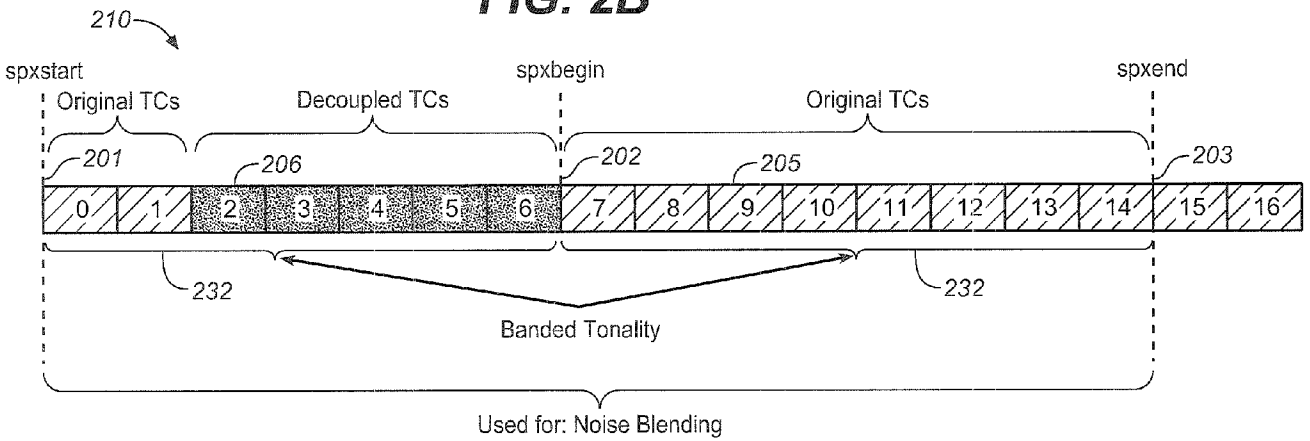
Figure 2D:
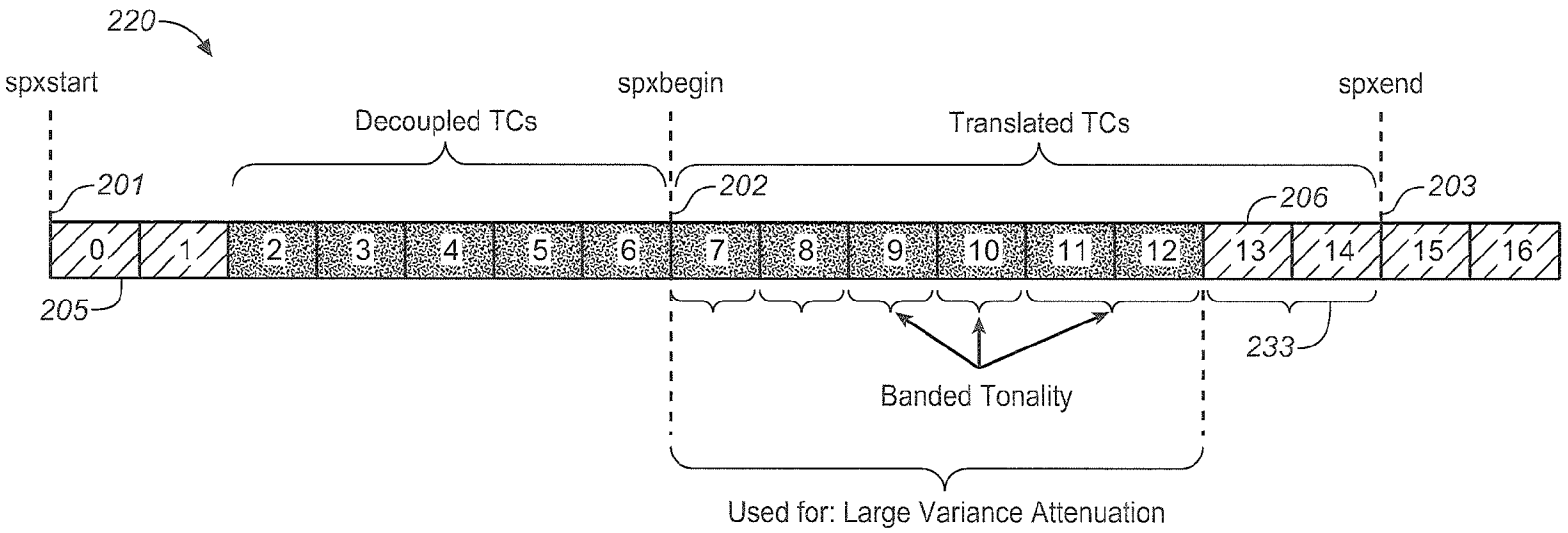

In FIGS. 2*a*, 2*b*, 2*c* and 2*d* the frequency (in the form of SPX subbands 0-16) is shown on the horizontal axis with markers for the SPX start band (or SPX start frequency) 201 (referred to as spxstart), the SPX begin band (or SPX begin frequency) 202 (referred to as spxbegin) and the SPX end band (or SPX end frequency) 203 (referred to as spxend). Typically, the SPX begin frequency 202 corresponds to the cutoff frequency 103. The SPX end frequency 203 may correspond to the bandwidth 104 of the original audio signal or to a frequency lower than the audio bandwidth 104 (as illustrated in FIGS. 2*a*, 2*b*, 2*c* and 2*d*). After encoding, the bandwidth of the encoded/decoded audio signal typically corresponds to the SPX end frequency 203. In an embodiment, the SPX start frequency 201 corresponds to frequency bin No. 25 and the SPX end frequency 203 corresponds to frequency bin No. 229. The subbands of the audio signal are shown at three different stages of the SPX encoding process: The spectrum 200 (e.g. the MDCT spectrum) of the original audio signal (FIG. 2*a*, top and FIG. 2*b*) and the spectrum 210 of the audio signal after encoding/decoding of the low frequency component of the audio signal (FIG. 2*a*, middle and FIG. 2*c*). The encoding/decoding of the low frequency component of the audio signal may e.g. comprise matrixing and dematrixing and/or coupling and decoupling of the low frequency component. Furthermore, the spectrum 220 after spectral translation of the subbands of the baseband 101 to the high frequency band 102 is shown (FIG. 2*a*, bottom and FIG. 2*d*). The spectrum 200 of the original parts of the audio signal is shown in the "Original"-line of FIG. 2*a* (i.e. frequency subbands 0-16); the spectrum 210 of the parts of the signal that are modified by coupling/matrixing are shown in the "Dematrixed/Decoupled Low-Band" line of FIG. 2*a* (i.e. frequency subbands 2-6 in the illustrated example); and the spectrum 220 of the parts of the signal that are modified by spectral translation are shown in the "translated high-band" line of FIG. 2*a* (i.e. frequency subbands 7-14 in the illustrated example). The subbands 206 which are modified by the processing of the SPX based encoder are illustrated as dark shaded, whereas the subbands 205 which remain unmodified by the SPX based encoder are illustrated as light shaded.

The braces 231, 232, 233 below the subbands and/or below groups of SPX subbands indicate for which subbands or for which groups of subbands tonality values (tonality measures) are calculated. Furthermore, it is indicated which purpose the tonality values or tonality measures are used for. The banded tonality values 231 (i.e. the tonality values for a subband or for a group of subband) of the original input signal between the SPX start band (spxstart) 201 and the SPX end band (spxend) 203 are typically used to steer the decision of the encoder on whether new SPX coordinates need to be transmitted or not ("re-send strategy"). The SPX coordinates typically carry information about the spectral envelope of the original audio signal in the form of gain factors for each SPX band. The SPX re-send strategy may indicate whether new SPX coordinates have to be transmitted for a new block of samples of the audio signal or whether the SPX coordinates for a (directly) preceding block of samples can be re-used. Additionally, the banded tonality values 231 for the SPX bands above spxbegin 202 may be used as an input to the large variance attenuation (LVA) computations, as illustrated in FIG. 2*a* and FIG. 2*b*. The large variance attenuation is an encoder tool which may be used to attenuate potential errors from the spectral translation. Strong spectral components in the extension band that do not have a corresponding component in the base band (and vice versa) may be considered to be extension errors. The LVA mechanism may be used to attenuate such extension errors. As can be seen by the braces in FIG. 2*b*, the tonality values 231 may be calculated for individual subbands (e.g. subbands 0, 1, 2, etc.) and/or for groups of subbands (e.g. for the group comprising subbands 11 and 12).

As indicated above, signal tonality plays an important role for determining the amount of noise blending applied to the reconstructed subbands in the high frequency band 102. As depicted in FIG. 2*c*, tonality values 232 are computed separately for the decoded (e.g. dematrixed and de-coupled) low-band and for the original high-band. Decoding (e.g. dematrixing and de-coupling) in this context means that the previously applied encoding steps (e.g. the matrixing and coupling steps) of the encoder are undone in the same way as it would be done in the decoder. In other words, such decoder mechanism is simulated already in the encoder. The low-band comprising subbands 0-6 of the spectrum 210 is thus a simulation of the spectrum that the decoder will recreate. FIG. 2*c* further shows that tonality is computed for two large bands (only) in this case, as opposed to the original signal's tonality which is calculated per SPX subband (which spans a multiple of 12 transform coefficients (TCs)) or per group of SPX subbands. As indicated by the braces in FIG. 2*c*, the tonality values 232 are computed for a group of subbands in the baseband 101 (e.g. comprising the subbands 0-6) and for a group of subbands in the high frequency band 102 (e.g. comprising the subbands 7-14).

In addition to the above, the large variance attenuation (LVA) computations typically require another tonality input which is calculated on the translated transform coefficients (TCs). Tonality is measured for the same spectral region as in FIG. 2*a*, but on different data, i.e. on the translated low-band subbands, and not on the original subbands. This is depicted in the spectrum 220 shown in FIG. 2*d*. It can be seen that tonality values 233 are determined for subbands and/or groups of subbands within the high frequency band 102 based on the translated subbands.

Overall, it can be seen that a typical SPX based encoder determines tonality values 231, 232, 233 on various subbands 205, 206 and/or groups of subbands of the original audio signal and/or of signals derived from the original audio signal in the course of the encoding/decoding process. In particular, tonality values 231, 232, 233 may be determined for subbands and/or groups of subbands of the original audio signal, of the encoded/decoded low frequency component of the audio signal and/or of the approximated high frequency component of the audio signal. As outlined above, the determination of tonality values 231, 232, 233 typically makes up a significant portion of the overall computational effort of an SPX based encoder. In the following, methods and systems are described which allow to significantly reduce the computational effort linked to the determination of the tonality values 231, 232, 233, thereby reducing the computational complexity of the SPX based encoder.

The tonality value of a subband 205, 206 may be determined by analyzing the evolution of the angular velocity $\omega(t)$ of the subbands 205, 206 along the time t. The angular velocity $\omega(t)$ may be the variation of the angle or phase $\varphi$ over time. Consequently, the angular acceleration may be determined as the variation of the angular velocity $\omega(t)$ over time, i.e. the first derivative of the angular velocity $\omega(t)$, or the second derivative of the phase $\varphi$. If the angular velocity $\omega(t)$ is constant along the time, the subband 205, 206 is tonal, and if the angular velocity $\omega(t)$ varies along the time, the subband 205, 206 is less tonal. Hence, the rate of change of the angular velocity $\omega(t)$ (i.e. the angular acceleration) is an indicator of the tonality. By way of example, the tonality values $T_q$ 231, 232, 233 of a subband q or of a group of subbands q may be determined as $$T_q = 1 - \left|\frac{\partial \omega(t)}{\partial t}\right| = 1 - |\alpha|, \ (|\alpha| \leq 1)$$

In the present document, it is proposed to split up the determination of the tonality values $T_q$ 231, 232, 233 of a subband q or of a group of subbands q (also referred to as banded tonality values) into a determination of tonality values $T_n$ for the different transform coefficients TC (i.e. for different frequency bins n) obtained by the time-domain to frequency-domain transform (also referred to as bin tonality values) and to subsequently determine the banded tonality values $T_q$ 231, 232, 233 based on the bin tonality values $T_n$. As is shown below, this two-step determination of the banded tonality values $T_q$ 231, 232, 233 allows for a significant reduction of the computational effort linked to the calculation of the banded tonality values $T_q$ 231, 232, 233.

In the discrete time-domain, the bin tonality value $T_{n,k}$ for a transform coefficient TC of a frequency bin n and at block (or discrete time instant) k may be determined e.g. based on the formula $$T_{n,k} = w_{n,k} \cdot \left(1 - \frac{|anglenorm(\varphi_{n,k} - 2 \cdot \varphi_{n,k-1} + \varphi_{n,k-2})|}{\pi}\right) \cdot |TC_{n,k}|^2,$$

wherein $\varphi_{n,k}$, $\varphi_{n,k-1}$ and $\varphi_{n,k-2}$ are the phases of the transform coefficient TC of the frequency bin n at time instants k, k−1 and k−2, respectively, wherein $|TC_{n,k}|^2$ is the squared magnitude of the transform coefficient TC of the frequency bin n at time instants k, and wherein $w_{n,k}$ is a weighting factor for the frequency bin n at time instant k. The "anglenorm" function normalizes its argument to the range $(-\pi;\pi]$ by repeated addition/subtraction of $2\pi$. The "anglenorm" function is given in Table 1.

TABLE 1

```
function anglenorm(x)
{
    while (x > PI)
    {
        x = x − 2* PI;
    }
    while (x <= − 2* PI
    {
        x = x + 2* PI;
    }
    return x;
}
```

The tonality value $T_{q,k}$ 231, 232, 233 of a subband q 205, 206 or of a group of subbands q 205, 206 at a time instant k (or for a block k) may be determined based on the tonality values $T_{n,k}$ of the frequency bins n at the time instant k (or for the block k) comprised within the subband q 205, 206 or within the group of subbands q 205, 206 (e.g. based on the sum of or the average of the tonality values $T_{n,k}$). In the present document, the time index (or block index) k and/or the bin index n/subband index q may have been omitted for conciseness reasons.

The phase $\varphi_k$ (for a particular bin n) may be determined from the real and imaginary part of a complex TC. The complex TCs may be determined at the encoder side e.g. by performing an MDST and an MDCT transform of a block of N samples of the audio signal, thereby yielding the real part and the imaginary part of the complex TCs, respectively. Alternatively complex time-domain to frequency-domain transforms may be used, thereby yielding complex TCs. The phase $\varphi_k$ may then be determined as $$\varphi_k = a\tan 2(Im\{TC_k\}, Re\{TC_k\}), -\pi < \varphi_k \leq \pi.$$

The a tan 2 function is specified e.g. at the internet link http://de.wikipedia.org/wiki/Atan2#atan2. In principle, the a tan 2 function may be described as an arctangent function of the ratio of $y=Im\{TC_k\}$ and $x=Re\{TC_k\}$ which takes into account negative values of $y=Im\{TC_k\}$ and/or $x=Re\{TC_k\}$. As outlined in the context of FIGS. 2*a*, 2*b*, 2*c* and 2*d*, different banded tonality values 231, 232, 233 may need to be determined based on different spectral data 200, 210, 220 derived from the original audio signal. It has been observed by the inventor based on the overview shown in FIG. 2*a* that different banded tonality computations are actually based on the same data, in particular based on the same transform coefficients (TCs):

The tonality of the original high frequency band TCs is used to determine the SPX coordinate re-send strategy and the LVA, as well as to calculate the noise blending factor b. In other words, the bin tonality values $T_n$ of the TCs of the original high frequency band 102 may be used to determine the banded tonality values 231 and the banded tonality value 232 within the high frequency band 102.

The tonality of the de-coupled/dematrixed low-band TCs is used to determine the noise blending factor b and—after translation to the high-band—is used in the LVA calculations. In other words, the bin tonality values $T_n$ which are determined based on the TCs of the encoded/decoded low frequency component of the audio signal (spectrum 210) are used to determine the banded tonality value 232 in the baseband 101 and to determine the banded tonality values 233 within the high frequency band 102. This is due to the fact that the TCs of the subbands within the high frequency band 102 of spectrum 220 are obtained by a translation of one or more encoded/decoded subbands in the baseband 101 to one or more subbands in the high frequency band 102. This translation process does not impact the tonality of the copied TCs, thereby allowing a reuse of the bin tonality values $T_n$ which are determined based on the TCs of the encoded/decoded low frequency component of the audio signal (spectrum 210).

The de-coupled/dematrixed low-band TCs typically only differ from the original TCs in the coupling region (assuming that matrixing is completely reversible, i.e. assuming that the dematrixing operation reproduces the original transform coefficients). Tonality computations for subbands (and for TCs) between the SPX start frequency 201 and the coupling begin (cplbegin) frequency (assumed to be at subband 2 in the illustrated example) are based on the unmodified original TCs and are thus the same for de-coupled/dematrixed low-band TCs and for the original TCs (as illustrated in FIG. 2*a* by the light shading of subbands 0 and 1 in the spectrum 210).

The observations stated above suggest that some of the tonality calculations do not need to be repeated or at least do not need to be completely performed since previously calculated intermediate results can be shared, i.e. reused. In many cases, previously computed values can thus be reused, which significantly reduces computational cost. In the following, various measures are described which allow to reduce the computational cost related to the determination of tonality within an SPX based encoder.

As can be seen from the spectra 200 and 210 in FIG. 2*a*, the subbands 7-14 of the high frequency band 102 are the same in the spectra 200 and 210. As such, it should be possible to reuse the banded tonality values 231 for the high frequency band 102 also for the banded tonality value 232. Unfortunately, a look at FIG. 2*a* reveals that tonality is computed for a different band structure in both cases, even though the underlying TCs are the same. Hence, in order to be able to reuse tonality values, it is proposed to split up the tonality computation into two parts, wherein the output of the first part can be used to calculate the banded tonality values 231 and 232.

As already outlined above, the computation of banded tonalities $T_q$ can be separated into calculating the per-bin tonality $T_n$ for each TC (step 1) and a subsequent process of smoothing and grouping of the bin tonality values $T_n$ into bands (step 2), thereby yielding the respective banded tonality values $T_q$ 231, 232, 233. The banded tonality values $T_q$ 231, 232, 233 may be determined based on a sum of the bin tonality values $T_n$ of the bins comprised within the band or subband of the banded tonality value, e.g. based on a weighted sum of the bin tonality values $T_n$. By way of example, a banded tonality value $T_q$ may be determined based on the sum of the relevant bin tonality values $T_n$ divided by the sum of the corresponding weighting factors $w_n$. Furthermore, the determination of the banded tonality values $T_q$ may comprise a stretching and/or mapping of the (weighted) sum to a pre-determined value range (of e.g. [0,1]). From the result of step 1, arbitrary banded tonality values $T_q$ can be derived. It should be noted that the computational complexity resides mainly in step 1, which therefore makes up the efficiency gain of this two-step approach.

Figure 3A:
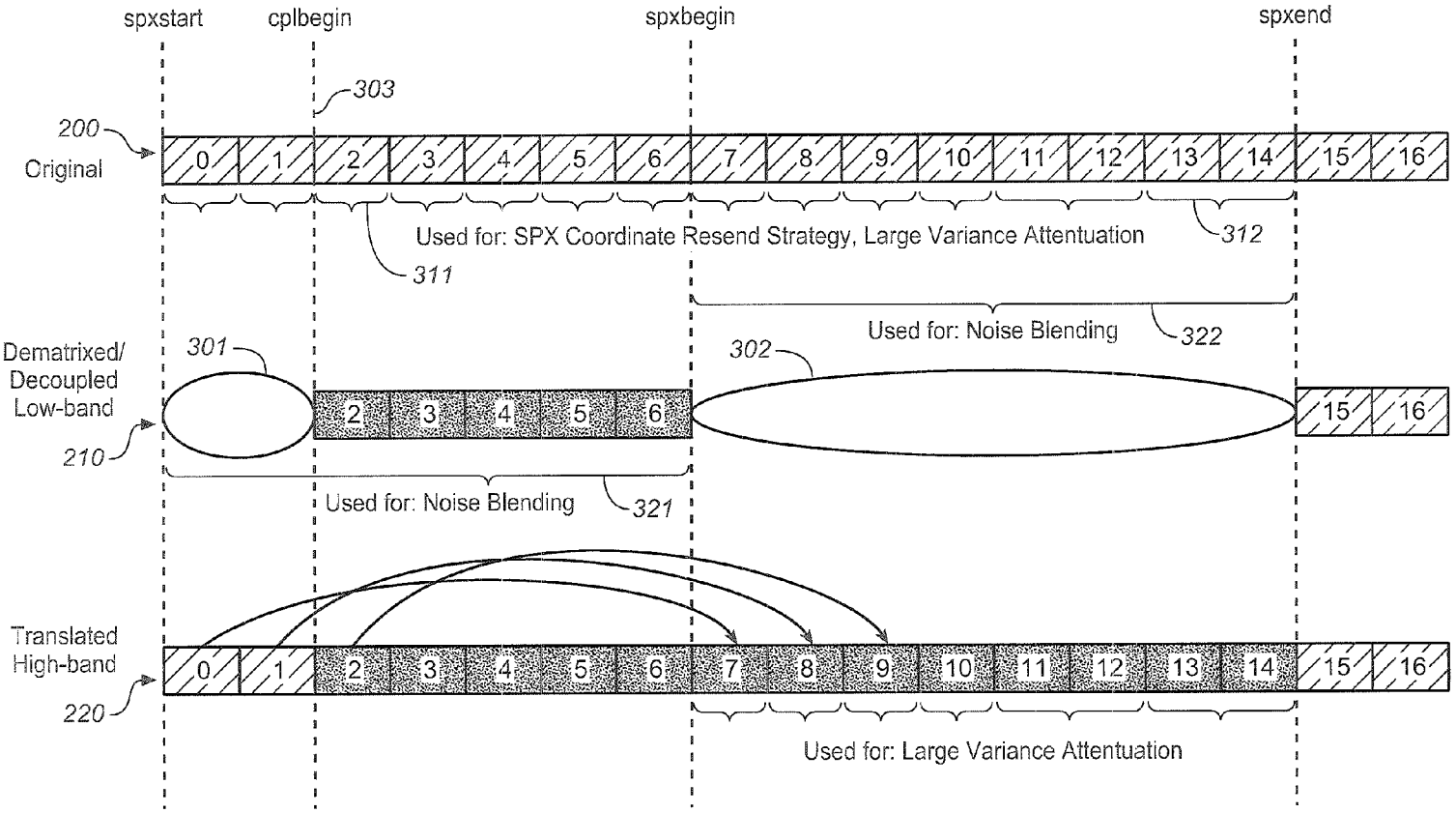
Figure 3B:
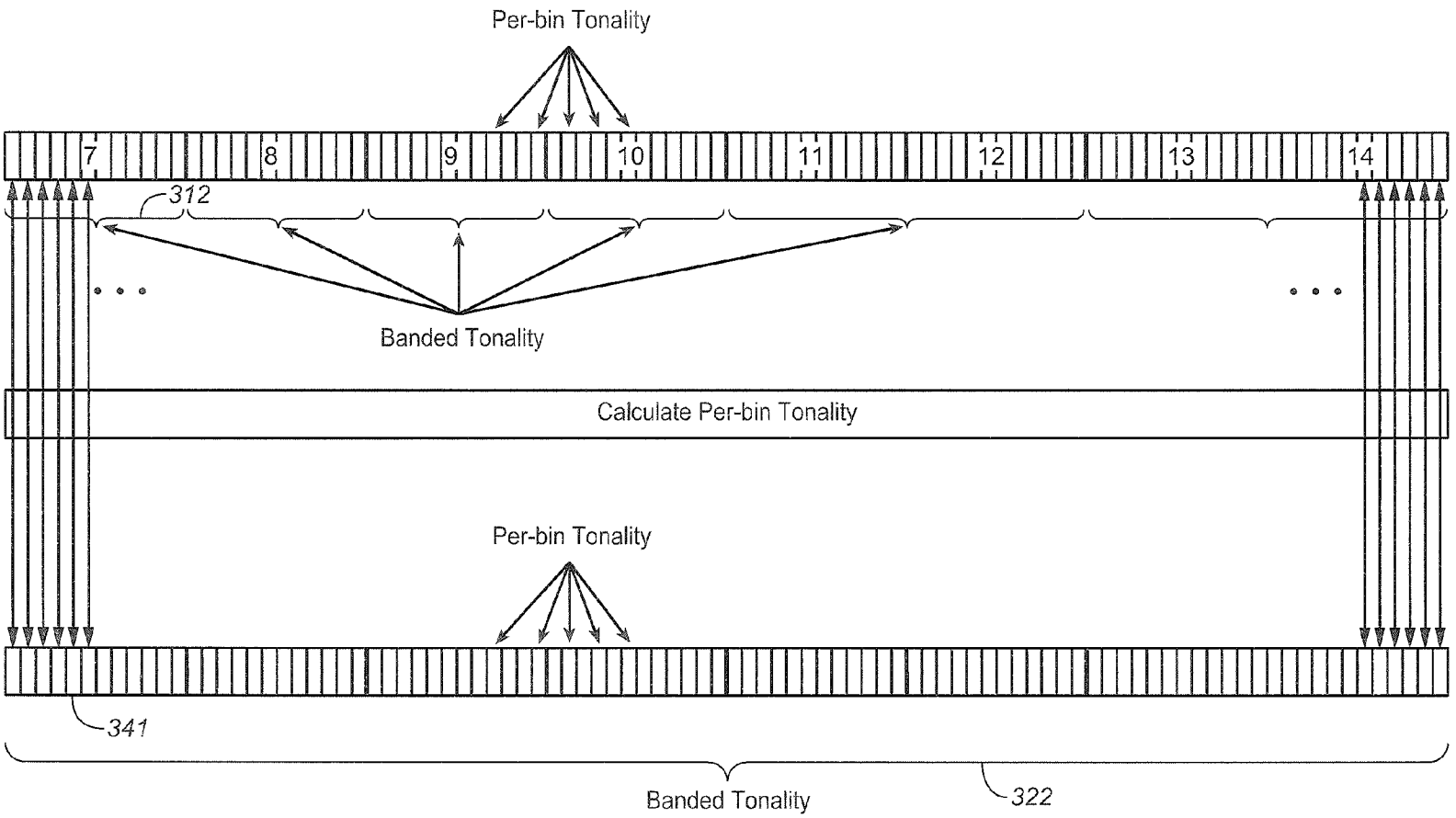

The two-step approach for determining the banded tonality values $T_q$ is illustrated in FIG. 3*b* for the subbands 7-14 of the high frequency band 102. It can be seen that in the illustrated example, each subband is made up from 12 TCs in 12 corresponding frequency bins. In a first step (step 1), bin tonality values $T_n$ 341 are determined for the frequency bins of the subbands 7-14. In a second step (step 2), the bin tonality values $T_n$ 341 are grouped in different ways, in order to determine the banded tonality values $T_q$ 312 (which corresponds to the banded tonality values $T_q$ 231 in the high frequency band 102) and in order to determine the banded tonality value $T_q$ 322 (which corresponds to the banded tonality values $T_q$ 232 in the high frequency band 102).

As a result, the computational complexity for determining the banded tonality value 322 and the banded tonality values 312 can be reduced by almost 50%, as the banded tonality values 312, 322 make use of the same bin tonality values 341. This is illustrated in FIG. 3*a* which shows that by reusing the original signal's high-band tonality also for noise blending and consequently removing the extra calculations (reference numeral 302), the number of tonality computations can be reduced. The same applies to the bin tonality values 341 for the subbands 0, 1 below the coupling begin (cplbegin) frequency 303. These bin tonality values 341 can be used for determining the banded tonality values 311 (which correspond to the banded tonality values $T_q$ 231 in the baseband 101), and they can be reused for determining the banded tonality value 321 (which corresponds to the banded tonality values $T_q$ 232 in the baseband 101).

It should be noted that the two-step approach for determining the banded tonality values is transparent with regards to the encoder output. In other words, the banded tonality values 311, 312, 321 and 322 are not affected by the two-step calculation and are therefore identical to the banded tonality values 231, 232 which are determined in a one-step calculation.

Figure 3C:
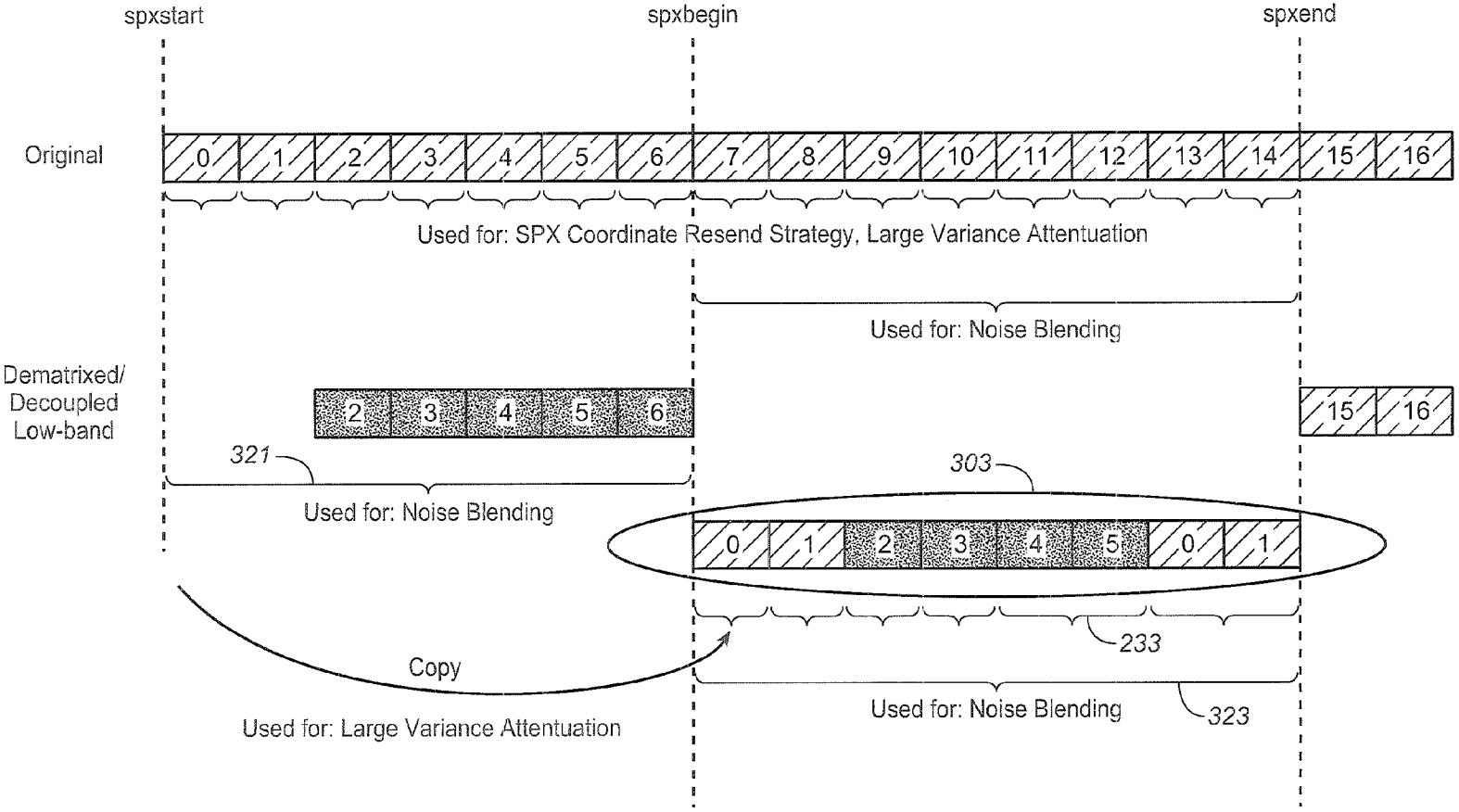
Figure 3D:
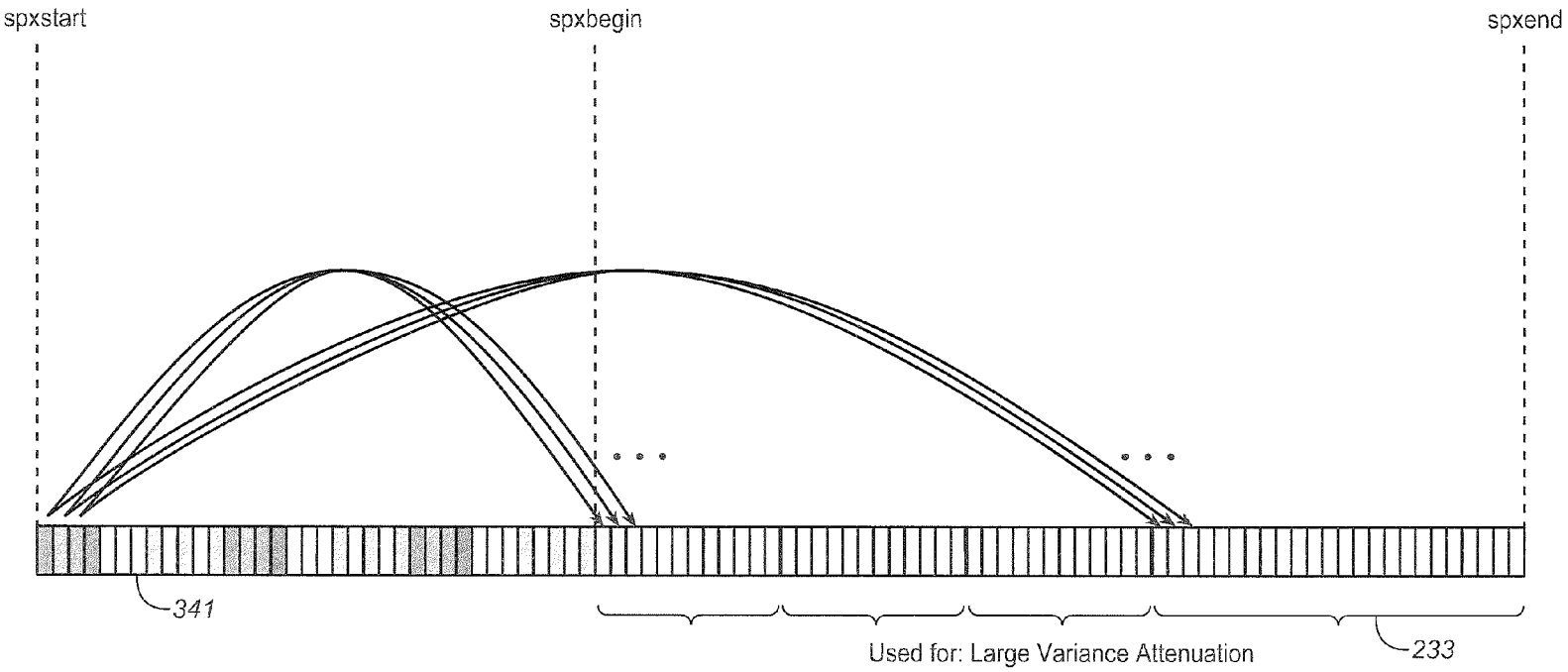

The reuse of bin tonality values 341 may also be applied in the context of spectral translation. Such a reuse scenario typically involves dematrixed/decoupled subbands from the baseband 101 of spectrum 210. A banded tonality value 321 of these subbands is computed when determining the noise blending factor b (see FIG. 3*a*). Again, at least some of the same TCs which are used to determine the banded tonality value 321 are used to calculate banded tonality values 233 that control the Large Variance Attenuation (LVA). The difference to the first reuse scenario outlined in the context of FIGS. 3*a* and 3*b* is that the TCs are subject to spectral translation before they are used to compute the LVA tonality values 233. However, it can be shown that the per-bin tonality $T_n$ 341 of a bin is independent from the tonality of its neighboring bins. As a consequence, per-bin tonality values $T_n$ 341 can be translated in frequency in the same way as it is done for the TCs (see FIG. 3*d*). This enables the reuse of the bin tonality values $T_n$ 341 calculated in the baseband 101 for noise blending, in the computations of the LVA in the high frequency band 102. This is illustrated in FIG. 3*c*, where it is shown how the subbands in the reconstructed high frequency band 102 are derived from the subbands 0-5 from the baseband 101 of spectrum 210. In accordance to the spectral translation process, the bin tonality values $T_n$ 341 of the frequency bins comprised within the subbands 0-5 from the baseband 101 can be reused to determine the banded tonality values $T_q$ 233. As a result, the computational effort for determining the banded tonality values $T_q$ 233 is significantly reduced, as illustrated by the reference numeral 303. Again, it should be noted that the encoder output is not affected by this modified way of deriving the extension band tonality 233.

Overall, it has been shown that by splitting up the determination of banded tonality values $T_q$ into a two-step approach which involves a first step of determining per-bin tonality values $T_n$ and a subsequent second step of determining the banded tonality values $T_q$ from the per-bin tonality values $T_n$, the overall computational complexity related to the computation of the banded tonality values $T_q$ can be reduced. In particular, it has been shown that the two-step approach allows the reuse of per-bin tonality values $T_n$ for the determination of a plurality of banded tonality values $T_q$ (as illustrated by the reference numerals 301, 302, 303 which indicate the reuse potential), thereby reducing the overall computational complexity.

The performance improvement resulting from the two-step approach and the reuse of bin tonality values can be quantified by comparing the number of bins for which tonality is typically computed. The original scheme computes tonality values for $$2\cdot(spx\text{end}-spx\text{start})+(spx\text{end}-spx\text{begin})+6$$

frequency bins (wherein the additional 6 tonality values are used to configure specific notch filters within the SPX based encoder). By reusing computed tonality values as described above, the number of bins, for which a tonality value is determined, is reduced to $$spx\text{end}-spx\text{start}-cpl\text{begin}+spx\text{start}+\min(spx\text{end}-spx\text{begin}+3, spx\text{begin}-spx\text{start})=spx\text{end}-cpl\text{begin}+\min(spx\text{end}-spx\text{begin}+3, spx\text{begin}-spx\text{start})$$

(wherein the additional 3 tonality values are used to configure specific notch filters within the SPX based encoder). The ratio of the bins, for which tonality is computed before and after the optimization, yields the performance improvement (and the complexity reduction) for the tonality algorithm. It should be noted that the two-step approach is typically slightly more complex than the direct computation of banded tonality values. The performance gain (i.e. the complexity reduction) for the complete tonality computation is thus slightly less than the ratio of computed tonality bins which can be found in Table 2 for different bit rates.

TABLE 2

| Bit rate (kbps) | Tonality bin ratio after/before |
|---|---|
| 128 | 0.50 |
| 192 | 0.52 |
| 256 | 0.45 |
| 320 | 0.41 |

It can be seen that a reduction of the computational complexity for computing the tonality values of 50% and higher can be achieved.

As outlined above, the two-step approach does not affect the output of the encoder. In the following, further measures for reducing the computational complexity of an SPX based encoder are described which might affect the output of the encoder. However, perceptual tests have shown that—in average—these further measures do not affect the perceived quality of encoded audio signals. The measures described below may be used alternatively or in addition to the other measures described in the present document.

As shown e.g. in the context of FIG. 3*c*, the banded tonality values $T_{low}$ 321 and $T_{high}$ 322 are the basis for the computation of the noise blending factor b. Tonality can be interpreted as a property which is more or less inverse to the amount of noise contained in the audio signal (i.e. more noisy→less tonal and vice versa). The noise blending factor b may be calculated as $$b=T_{low}\cdot(1-\text{var}\{T_{low}, T_{high}\})+T_{high}\cdot(\text{var}\{T_{low}, T_{high}\}),$$

where $T_{low}$ 321 is the tonality of the decoder-simulated low-band, $T_{high}$ 322 is the tonality of the original high-band and $$\text{var}\{T_{low}, T_{high}\}=\left(\frac{T_{low}-T_{high}}{T_{low}+T_{high}}\right)^2$$

is the variance of the two tonality values $T_{low}$ 321 and $T_{high}$ 322.

The goal of noise blending is to insert as much noise into the regenerated high-band as is necessary to make the regenerated high-band sound like the original high-band. The source tonality value (reflecting the tonality of the translated subbands in the high frequency band 102) and the target tonality value (reflecting the tonality of the subbands in the original high frequency band 102) should be taken into account to determine the desired target noise level. It is an observation of the inventor that the true source tonality is not correctly described by the tonality value $T_{low}$ 321 of the decoder-simulated low-band, but rather by a tonality value $T_{copy}$ 323 of the translated high-band copy (see FIG. 3*c*). The tonality value $T_{copy}$ 323 may be determined based on the subbands which approximate the original subbands 7-14 of the high frequency band 102 as illustrated by the brace in FIG. 3*c*. It is on the translated high-band that noise blending is performed and thus only the tonality of the low-band TCs which are actually copied into the high-band should influence the amount of noise to be added.

As indicated by the formula above, currently the tonality value $T_{low}$ 321 from the low-band is used as an estimate of the true source tonality. There may be two cases that influence the accuracy of this estimate:

The low-band which is used to approximate the high-band is smaller than or equal to the high-band and the encoder does not encounter a mid-band wrap-around (i.e. the target band is larger than the available source bands at the end of the copy region (i.e. the region between spxstart and spxbegin)). The encoder typically tries to avoid such wrap-around situations within a target SPX band. This is illustrated in FIG. 3*c*, where the translated subband 5 is followed by the subbands 0 and 1 (in order to avoid a wrap-around situation of subband 6 following subband 0 within the target SPX band). In this case, the low-band is typically copied up completely, possibly multiple times, to the high-band. Since all TCs are being copied, the tonality estimate for the low-band should be fairly close to the tonality estimate of the translated high-band.

The low-band is larger than the high-band. In this case, only the lower part of the low-band is copied up to the high-band. Since the tonality value $T_{low}$ 321 is computed for all low-band TCs, the tonality value $T_{copy}$ 323 of the translated high-band may deviate from the tonality value $T_{low}$ 321, depending on the signal properties and depending on the size ratio of the low-band and the high-band.

As such, the use of the tonality value $T_{low}$ 321 may lead to an inaccurate noise blending factor b, notably in cases where not all the subbands 0-6 which are used to determine the tonality value $T_{low}$ 321 are translated to the high frequency band 102 (as is the case e.g. in the example shown in FIG. 3*c*). Significant inaccuracies may occur in cases where the subbands which are not copied to the high frequency band 102 (e.g. subband 6 in FIG. 3*c*) comprise significant tonal content. It is therefore proposed to determine the noise blending factor b based on the banded tonality value $T_{copy}$ 323 of the translated high-band (and not on the banded tonality value $T_{low}$ 321 of the decoder-simulated low-band going from the SPX start frequency 201 to the SPX begin frequency 202. In particular, the noise blending factor b may be determined as $$b=T_{copy}\cdot(1-\mathrm{var}\{T_{copy},T_{high}\})+T_{high}\cdot(\mathrm{var}\{T_{copy},T_{high}\}),$$

where $$\mathrm{var}\{T_{copy},\ T_{high}\}=\left(\frac{T_{copy}-T_{high}}{T_{copy}+T_{high}}\right)^2$$

is the variance of the two tonality values $T_{copy}$ 323 and $T_{high}$ 322.

In addition to potentially providing an improved quality of the SPX based encoder, the use of the banded tonality value $T_{copy}$ 323 of the translated high-band (instead of the banded tonality value $T_{low}$, 321 of the decoder-simulated low-band) may lead to a reduced computational complexity of the SPX based audio encoder. This is particularly true for the above mentioned case 2, where the translated high-band is narrower than the low-band. This benefit grows with the disparity of low-band and high-band sizes. The amount of bands for which source tonality is computed may be $$\min\{spx\mathrm{begin}-spx\mathrm{start},spx\mathrm{end}-spx\mathrm{begin}\},$$

wherein the number (spxbegin−spxstart) applies if the noise blending factor b is determined based on the banded tonality value $T_{low}$ 321 of the decoder-simulated low-band and wherein the number (spxend−spxbegin) applies if the noise blending factor b is determined based on the banded tonality value $T_{copy}$ 323 of the translated high-band. As such, in an embodiment, the SPX based encoder may be configured to select the mode of determination of the noise blending factor b (a first mode based on the banded tonality value $T_{low}$ 321 and a second mode based on the banded tonality value $T_{copy}$ 323), depending on the minimum of (spxbegin−spxstart) and (spxend−spxbegin), thereby reducing the computational complexity (notably in cases where (spxend−spxbegin) is smaller than (spxbegin−spxstart).

It should be noted that the modified scheme for determining the noise blending factor b may be combined with the two-step approach for determining the banded tonality values $T_{copy}$ 323 and/or $T_{high}$ 322. In this case, the banded tonality value $T_{copy}$ 323 is determined based on the bin tonality values $T_n$ 341 of the frequency bins which have been translated to the high frequency band 102. The frequency bins contributing to the reconstructed high frequency band 102 lie between spxstart 201 and spxbegin 202. In the worst case with regards to computational complexity, all the frequency bins between spxstart 201 and spxbegin 202 contribute to the reconstructed high frequency band 102. On the other hand, in many other case (as illustrated e.g. in FIG. 3*c*) only a subset of the frequency bins between spxstart 201 and spxbegin 202 are copied to the reconstructed high frequency band 102. In view of this, in an embodiment, the noise blending factor b is determined based on the banded tonality value $T_{copy}$ 323 using the bin tonality values $T_n$ 341, i.e. using the above mentioned two-step approach for determining the banded tonality value $T_{copy}$ 323. By using the two-step approach, it is ensured that even in cases where (spxbegin−spxstart) is smaller than (spxend−spxbegin), the computational complexity is limited by the computational complexity required for determining the bin tonality values $T_n$ 341 in the frequency range between spxstart 201 and spxbegin 202. In other words, the two-step approach ensures that even in cases where (spxbegin−spxstart) is smaller than (spxend−spxbegin), the computational complexity for determining the banded tonality value $T_{copy}$ 323 is limited by the number of TCs comprised between (spxbegin−spxstart). As such, the noise blending factor b can consistently be determined based on the banded tonality value $T_{copy}$ 323. Nevertheless, it may be beneficial to determine the minimum of (spxbegin−spxstart) and (spxend−spxbegin), in order to determine the subbands in the coupling region (cplbegin to spxbegin) for which the tonality values should be determined. By way of example, if (spxbegin−spxstart) is larger than (spxend−spxbegin), it is not required to determine the tontality values for at least some of the subbands of the frequency region (spxbegin−spxstart), thereby reducing the computational complexity.

As can be seen in FIG. 3*c*, the two-step approach for determining the banded tonality values from the bin tonality values allows for a significant reuse of bin tonality values, thereby reducing the computational complexity. The determination of bin tonality values is mainly reduced to the determination of bin tonality values based on the spectrum 200 of the original audio signal. However, in case of coupling, bin tonality values may need to be determined based on the coupled/decoupled spectrum 210 for some or all of the frequency bins between cplbegin 303 and spxbegin 202 (for the frequency bins of the dark shaded subbands 2-6 in FIG. 3*c*). In other words, after exploiting the above mentioned means of reusing previously computed per-bin tonality, the only bands that may require tonality re-computation are the bands that are in coupling (see FIG. 3*c*).

Coupling usually removes the phase differences between the channels of a multi-channel signal (e.g. a stereo signal or a 5.1 multi-channel signal) that are in coupling. Frequency sharing and time sharing of the coupling coordinates further increase correlation between the coupled channels. As outlined above, the determination of tonality values is based on phases and energies of the current block of samples (at time instant k) and of one or more preceding blocks of samples (e.g. at time instants k−1, k−2). Since the phase angles of all channels in coupling are the same (as a result of the coupling), the tonality values of those channels are more correlated than the tonality values of the original signal.

A corresponding decoder to an SPX based encoder only has access to the de-coupled signal which the decoder generates from the received bit stream comprising encoded audio data. Encoding tools like noise blending and large variance attenuation (LVA) on the encoder side typically take this into account when computing ratios that intend to reproduce the original high-band signal from the transposed de-coupled low-band signal. In other words, the SPX based audio encoder typically takes into account that the corresponding decoder only has access to the encoded data (representative of the de-coupled audio signal). Hence, the source tonality for noise blending and LVA is typically computed from the de-coupled signal in current SPX based encoder (as illustrated e.g. in the spectrum 210 of FIG. 2*a*). However, even though it conceptually makes sense to compute tonality based on the de-coupled signal (i.e. based on spectrum 210), the perceptual implications of computing the tonality from the original signal instead are not so clear. Furthermore, the computational complexity could be further reduced if the additional re-computation of tonality values based on the de-coupled signal could be avoided.

For this purpose, a listening experiment has been conducted to evaluate the perceptual influence of using the original signal's tonality instead of the tonality of the de-coupled signal (for determining the banded tonality values 321 and 233). The results of the listening experiment are illustrated in FIG. 4. MUSHRA (MUltiple Stimuli with Hidden Reference and Anchor) tests have been performed for a plurality of different audio signals. For each of the plurality of different audio signals the (left hand) bars 401 indicate the results obtained when determining the tonality values based on the de-coupled signal (using spectrum 210) and the (right hand) bars 402 indicate the results obtained when determining the tonality values based on the original signal (using spectrum 200). As can be seen, the audio quality obtained when using the original audio signal for the determination of the tonality values for noise blending and for LVA is the same on average as the audio quality obtained when using the de-coupled audio signal for the determination of the tonality values.

The results of the listening experiment of FIG. 4 suggest that the computational complexity for determining the tonality values can be further reduced by reusing the bin tonality values 341 of the original audio signal for determining the banded tonality value 321 and/or the banded tonality value 323 (used for noise blending) and the banded tonality values 233 (used for LVA). Hence, the computational complexity of the SPX based audio encoder can be reduced further, while not impacting (in average) the perceived audio quality of the encoded audio signals.

Even when determining the banded tonality values 321 and 233 based on the de-coupled audio signal (i.e. based on the dark shaded subbands 2-6 of spectrum 210 of FIG. 3*c*), the alignment of the phases due to coupling may be used to reduce the computational complexity linked to the determination of tonality. In other words, even if the re-computation of tonality for the coupling bands cannot be avoided, the decoupled signal exhibits a special property that may be used to simplify the regular tonality computation. The special property is that all the coupled (and subsequently de-coupled) channels are in phase. Since all channels in coupling share the same phase $\varphi$ for the coupling bands, this phase $\varphi$ only needs to be computed once for one channel and can then be reused in the tonality computations of the other channels in coupling. In particular, this means that the above mentioned "a tan 2" operation for determining the phase $\varphi_k$ at a time instant k only needs to be performed once for all the channels of a multi-channel signal which are in coupling.

It seems to be beneficial from a numeric point of view to use the coupling channel itself for the phase computation (instead of one of the de-coupled channels), since the coupling channel represents an average over all channels in coupling. Phase re-usage for the channels in coupling has been implemented in the SPX encoder. There are no changes in the encoder output due to the reuse of the phase values. The performance gain is about 3% (of the SPX encoder computational effort) for the measured configuration at a bit-rate of 256 kbps, but it is expected that the performance gain increases for lower bit-rates where the coupling region begins closer to the SPX start frequency 201, i.e. where the coupling begin frequency 303 lies closer to the SPX start frequency 201.

In the following, a further approach for reducing the computational complexity linked to the determination of tonality is described. This approach may be used alternatively or in addition to the other methods described in the present document. In contrast to the previously presented optimizations which focused on reducing the number of required tonality calculations, the following approach is directed at speeding up the tonality computation itself. In particular, the following approach is directed at reducing the computational complexity for determining the bin tonality value $T_{n,k}$ of a frequency bin n for a block k (the index k corresponds e.g. to a time instant k).

The SPX per-bin tonality value $T_{n,k}$ of bin n in block k may be computed as $$T_{n,k} = w_{n,k} \cdot \left(1 - \frac{|anglenorm(\varphi_{n,k} - 2 \cdot \varphi_{n,k-1} + \varphi_{n,k-2})|}{\pi}\right) \cdot Y_{n,k}$$

where $$Y_{\tau,k} = Re\{TC_{n,k}\}^2 + Im\{TC_{n,k}\}^2$$

is the power of bin n and block k, $w_{n,k}$ is a weighting factor and $$\varphi_{n,k} = a\tan 2(Re\{TC_{n,k}\}, Im\{TC_{n,k}\})$$

is the phase angle of bin n and block k. The above mentioned formula for the bin tonality value $T_{n,k}$ is indicative of the acceleration of the phase angle (as outlined in the context of the formulas given for the bin tonality value $T_{n,k}$ above). It should be noted that other formulas for determining the bin tonality value $T_{n,k}$ may be used. The speed-up of the tonality calculations (i.e. the reduction of the computational complexity) is mainly directed at the reduction of the computational complexity linked to the determination of the weighting factor w.

The weighting factor w may be defined as $$w_{n,k} = \begin{cases} \sqrt[4]{\dfrac{Y_{n,k}}{Y_{n,k\ 1}}} & \text{for } Y_{n,k} \le Y_{n,k-1} \\ \sqrt[4]{\dfrac{Y_{n,k-1}}{Y_{n,k}}} & \text{for } Y_{n,k} > Y_{n,k-1} \end{cases}.$$

The weighting factor w may be approximated by replacing the fourth root by a square root and the first iteration of the Babylonian/Heron method, i.e.

$$w_{n,k} \cong \begin{cases} 0 & \text{for } Y_{n,k} = 0 \cup Y_{n,k-1} = 0 \\ \dfrac{1}{2} + \dfrac{1}{2} \cdot \begin{cases} \sqrt{\dfrac{Y_{n,k}}{Y_{n,k-1}}} & \text{for } Y_{n,k} \le Y_{n,k-1} \\ \sqrt{\dfrac{Y_{n,k-1}}{Y_{n,k}}} & \text{for } Y_{n,k} > Y_{n,k-1} \end{cases} \end{cases}.$$

Although the removal of one square root operation already increases efficiency, there is still one square root operation and a division per block, per channel and per frequency bin. A different and computationally more effective approximation can be derived in the logarithmic domain by rewriting the weighting factor w as:

$$w_{n,k} = \begin{cases} 2^{log_2\left(\sqrt[4]{\frac{Y_{n,k}}{Y_{n,k-1}}}\right)} = 2^{\frac{1}{4}(log_2(Y_{n,k}) - log_2(Y_{n,k-1}))} & \text{for } Y_{n,k} \le Y_{n,k-1} \\ 2^{log_2\left(\sqrt[4]{\frac{Y_{n,k-1}}{Y_{n,k}}}\right)} = 2^{\frac{1}{4}(log_2(Y_{n,k-1}) - log_2(Y_{n,k}))} & \text{for } Y_{n,k} > Y_{n,k-1} \end{cases}$$

The distinction of the cases can be abandoned by noting that the difference in the log domain is always negative, regardless whether ($Y_{n,k} \leq Y_{n,k-1}$) or ($Y_{n,k} > Y_{n,k-1}$), thereby yielding $$w_{n,k} = 2^{-1/4|log2(Y_{n,k}) - log2(Y_{n,k-1})|}.$$

For convenience of writing, the indices are dropped and $Y_{n,k}$ and $Y_{n,k-1}$ are replaced by y and z, respectively:

$$w = 2^{-1/4|log2(y) - log2(z)|}.$$

The variables y and z can now be split into an exponent $e_y$,$e_z$ and a normalized mantissa $m_y$,$m_z$, respectively, thereby yielding $$w = 2^{-1/4|log2(m_y \cdot 2^{e_y}) - log2(m_z \cdot 2^{e_z})|} = 2^{-1/4|e_y + log2(m_y) - e_z - log2(m_z)|}.$$

Assuming that the special case of an all-zero mantissa is treated separately, the normalized mantissas $m_y$,$m_z$ are within the interval [0,5;1]. The $\log_2$ (x) function in this interval may be approximated by the linear function $\log_2(x) \cong 2 \cdot x - 2$ with a maximum error of 0.0861 and a mean error of 0.0573. It should be noted that other approximations (e.g. a polynomial approximation) may be possible, depending on the desired precision of the approximation and/or the computational complexity. Using the above mentioned approximation yields $$w \cong 2^{-1/4|e_y - e_z + 2 \cdot m_y - 2 - (2 \cdot m_z - 2)|} = 2^{-1/4|e_y - e_z + 2 \cdot m_y - 2 \cdot m_z|}.$$

The difference of the mantissa approximations still has a maximum absolute error of 0.0861, but the mean error is zero, so that the range of the maximum error changes from [0;0.0861] (positively biased) to [−0.0861;0.0861].

Splitting the result of the division by 4 into an integer part and a remainder yields $$w \simeq 2^{-int\{\frac{1}{4}|e_y - e_z + 2 \cdot m_y - 2 \cdot m_z|\} - \frac{mod\{|e_y - e_z + 2 \cdot m_y - 2 \cdot m_z|, 4\}}{4}},$$

wherein the int{ . . . } operation returns the integer part of its operand by truncation, and wherein the mod {a, b} operation returns the remainder of a/b. In the above approximation of the weighting factor w, the first expression $$2^{-int\{1/4|e_y - e_z + 2 \cdot m_y - 2 \cdot m_z|\}}$$

translates to a simple shift operation towards the right by $$int\{1/4|e_y - e_z + 2 \cdot m_y - 2 \cdot m_z|\}$$

on a fixed point architecture. The second expression $$2^{-\frac{mod\{|e_y - e_z + 2 \cdot m_y - 2 \cdot m_z|, 4\}}{4}}$$

can be computed by using a pre-determined lookup table comprising powers of 2. The lookup table may comprise a pre-determined number of entries, in order to provide a pre-determined approximation error.

For the purpose of designing a suitable lookup table it is useful to recall the approximation error of the mantissas. The error introduced by the quantization of the lookup table does not need to be significantly lower than the average absolute approximation error of the mantissas, which is 0.0573, divided by 4. This yields a desired quantization error smaller than 0.0143. Linear quantization using a 64-entry lookup table results in a suitable quantization error of $1/128 = 0.0078$. As such, the pre-determined lookup table may comprise a total number of 64 entries. In general, the number of entries in the pre-determined lookup table should be aligned with the selected approximation of the logarithmic function. In particular, the precision of the quantization provided by the lookup table should be in accordance to the precision of the approximation of the logarithmic function.

A perceptual evaluation of the above approximation method indicated that the overall quality of the encoded audio signal is improved when the estimation error of the bin tonality values is positively biased, i.e. when the approximation is more likely to overestimate the weighting factor (and the resulting tonality values) than underestimating the weighting factor. In order to achieve such overestimation, a bias may be added to the lookup table, e.g. a bias of half a quantization step may be added. A bias of half a quantization step may be implemented by truncating the index into the quantization lookup table instead of rounding the index. It may be beneficial to limit the weighting factor to 0.5, in order to match the approximation obtained by the Babylonian/Heron method.

The approximation 503 of the weighting factor w resulting from the log domain approximation function is shown in FIG. 5*a*, together with the bounds of its average and maximum error. FIG. 5*a* also illustrates the exact weighting factor 501 using the fourth root and the weighting factor 502 determined using the Babylonian approximation. The perceptual quality of the log domain approximation has been verified in a listening test using the MUSHRA testing scheme. It can be seen in FIG. 5*b* that the perceived quality using the logarithmic approximation (left hand bars 511) is similar in average to the perceived quality using the Babylonian approximation (middle bars 512) and the fourth root (right hand bars 513). On the other hand, by using the logarithmic approximation, the computational complexity of the overall tonality computation may be reduced by about 28%.

In the present document, various schemes for reducing the computational complexity of an SPX based audio encoder have been described. Tonality computations have been identified as a main contributor to the computational complexity of the SPX based encoder. The described methods allow for a reuse of already calculated tonality values, thereby reducing the overall computational complexity. The reuse of already calculated tonality values typically leaves unaffected the output of the SPX based audio encoder. Furthermore, alternative ways for determining the noise blending factor b have been described which allow for a further reduction of the computational complexity. In addition, an efficient approximation scheme for the per-bin tonality weighting factor has been described, which may be used to reduce the complexity of the tonality computation itself without impairing the perceived audio quality. As a result of the schemes described in the present document an overall reduction of the computational complexity for an SPX based audio encoder in the range of 50% and beyond can be expected—depending on the configuration and bit rate.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

A person skilled in the art will easily be able to apply the various concepts outlined above to reach further embodiments specifically adapted to current audio coding requirements.

The invention claimed is:

1. A method for encoding a multi-channel audio signal by determining a plurality of tonality values for a plurality of coupled channels of the multi-channel audio signal, the method comprising:

receiving the multi-channel audio signal, wherein the multi-channel audio signal comprises a time-domain audio signal;

transforming the multi-channel audio signal from the time-domain audio signal to a frequency-domain audio signal;

determining a first sequence of transform coefficients for a corresponding sequence of blocks of samples of a first channel of the plurality of coupled channels;

determining a first sequence of phases based on the sequence of first transform coefficients;

determining a first phase acceleration based on the sequence of first phases;

determining a first tonality value for the first channel based on the first phase acceleration;

determining a second tonality value for a second channel of the plurality of coupled channels based on the first phase acceleration; and encoding the plurality of coupled channels of the multi-channel audio signal using the plurality of tonality values, including the first tonality value for the first channel and the second tonality value for the second channel, to generate an encoded audio signal.

2. A method for decoding an encoded audio bitstream, the method comprising:

receiving the encoded audio bitstream, wherein the encoded audio bitstream corresponds to an encoded audio signal; and decoding the encoded audio bitstream, wherein the encoded audio bitstream was generated at least in part by the method of claim 1.

3. A method for encoding a multi-channel audio signal by determining a banded tonality value for a first channel of the multi-channel audio signal in a Spectral Extension, referred to as SPX, based encoder configured to approximate a high frequency component of the first channel from a low frequency component of the first channel; wherein the first channel is coupled by the SPX based encoder with one or more other channels of the multi-channel audio signal; wherein the banded tonality value is used for determining a noise blending factor; wherein the banded tonality value is indicative of the tonality of an approximated high frequency component prior to noise blending; the method comprising:

receiving the multi-channel audio signal, wherein the multi-channel audio signal comprises a time-domain audio signal;

transforming the multi-channel audio signal from the time-domain audio signal to a frequency-domain audio signal;

providing a plurality of transform coefficients based on the first channel prior to coupling;

determining the banded tonality value based on the plurality of transform coefficients; and encoding the first channel and the one or more other channels of the multi-channel audio signal using the banded tonality value to generate an encoded audio signal.

4. A method for decoding an encoded audio bitstream, the method comprising:

receiving the encoded audio bitstream, wherein the encoded audio bitstream corresponds to an encoded audio signal; and decoding the encoded audio bitstream, wherein the encoded audio bitstream was generated at least in part by the method of claim 3.

5. A system configured to encode an audio signal by determining a noise blending factor of the audio signal; wherein the noise blending factor is used for approximating a high frequency component of the audio signal based on a low frequency component of the audio signal; wherein the high frequency component comprises one or more high frequency subband signals in a high frequency band; wherein the low frequency component comprises one or more low frequency subband signals in a low frequency band; wherein approximating the high frequency component comprises copying one or more low frequency subband signals to the high frequency band, thereby yielding one or more approximated high frequency subband signals; wherein the system is configured to:

receive the audio signal, wherein the audio signal comprises a time-domain audio signal;

transform the audio signal from the time-domain audio signal to a frequency-domain audio signal;

determine a target banded tonality value based on the one or more high frequency subband signals;

determine a source banded tonality value based on the one or more approximated high frequency subband signals;

determine the noise blending factor based on the target and source banded tonality values; and encode the audio signal using the noise blending factor, to generate an encoded audio signal.

6. A system configured to encode an audio signal by determining a first banded tonality value for a first frequency bin of the audio signal; wherein the first banded tonality value is used for approximating a high frequency component of the audio signal based on a low frequency component of the audio signal; wherein the system is configured to:

receive the audio signal, wherein the audio signal comprises a time-domain audio signal;

transform the audio signal from the time-domain audio signal to a frequency-domain audio signal;

provide a sequence of transform coefficients in the first frequency bin for a corresponding sequence of blocks of samples of the audio signal;

determine a sequence of phases based on the sequence of transform coefficients;

determine a phase acceleration based on the sequence of phases;

determine a bin power based on a current transform coefficient;

approximate a weighting factor indicative of a fourth root of a ratio of a power of succeeding transform coefficients using a logarithmic approximation;

weight the phase acceleration by the bin power and the approximated weighting factor to yield the first banded tonality value; and encode the audio signal using the first banded tonality value, to generate an encoded audio signal.

7. The system of claim 6, wherein the logarithmic approximation comprises a linear function.

8. The system of claim 6, wherein the logarithmic approximation comprises a polynomial.

9. The system of claim 6, wherein the logarithmic approximation comprises a linear function and a polynomial.

10. The system of claim 6, wherein the logarithmic approximation is computed using a lookup table.

11. A system for decoding an encoded audio bitstream, the system configured to:

receive the encoded audio bitstream, wherein the encoded audio bitstream corresponds to an encoded audio signal; and decode the encoded audio bitstream, wherein the encoded audio bitstream was generated at least in part by the system of claim 5.

12. A system for decoding an encoded audio bitstream, the system configured to:

receive the encoded audio bitstream, wherein the encoded audio bitstream corresponds to an encoded audio signal; and decode the encoded audio bitstream, wherein the encoded audio bitstream was generated at least in part by the system of claim 6.

* * * * *